US007103303B2

(12) United States Patent
Suzuki et al.

(10) Patent No.: US 7,103,303 B2
(45) Date of Patent: Sep. 5, 2006

(54) CHARGING APPARATUS AND IMAGE FORMING APPARATUS

(75) Inventors: Hiroyuki Suzuki, Yokohama (JP); Ryo Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 229 days.

(21) Appl. No.: 10/849,157

(22) Filed: May 20, 2004

(65) Prior Publication Data

US 2004/0265005 A1 Dec. 30, 2004

(30) Foreign Application Priority Data

May 21, 2003 (JP) ..... 2003-143466

(51) Int. Cl.
*G03G 15/02* (2006.01)

(52) U.S. Cl. ..... 399/175

(58) Field of Classification Search ..... None
See application file for complete search history.

(56) References Cited

U.S. PATENT DOCUMENTS

| | | | | |
|---|---|---|---|---|
| 5,424,812 | A | 6/1995 | Kemmochi et al. | 355/251 |
| 5,459,559 | A | 10/1995 | Nagase et al. | 355/251 |
| 5,576,812 | A | 11/1996 | Hibino et al. | 355/251 |
| 5,610,696 | A | 3/1997 | Kemmochi et al. | 399/285 |
| 6,330,411 | B1 | 12/2001 | Suzuki | 399/120 |
| 6,501,916 | B1 | 12/2002 | Suzuki | 399/30 |
| 6,909,859 | B1 * | 6/2005 | Nakamura et al. | 399/50 |
| 2005/0008396 | A1 * | 1/2005 | Nakamura et al. | 399/175 |

FOREIGN PATENT DOCUMENTS

| | | |
|---|---|---|
| JP | 11-149204 | 6/1999 |

* cited by examiner

*Primary Examiner*—Quana Grainger
(74) *Attorney, Agent, or Firm*—Fitzpatrick, Cella, Harper & Scinto

(57) ABSTRACT

A charging apparatus includes a first magnetic particle carrying member for carrying magnetic particles; a second magnetic particle carrying member for carrying the magnetic particles, the second magnetic particle carrying member being disposed downstream of the first magnetic particle carrying member with respect to a moving direction of a member to be charged, wherein the magnetic particle are commonly used by the first magnetic particle carrying member and the second magnetic particle carrying member, and the member to be charged is electrically charged by contacting the magnetic particles carried on the first magnetic particle carrying member and the second magnetic particle carrying member to the member to be charged; and current measuring means for measuring a current flowing between the first and second magnetic particle carrying members through the magnetic particles which exist between the first and second magnetic particles.

14 Claims, 14 Drawing Sheets

CHARGING APPARATUS AND IMAGE FORMING APPARATUS

FIELD OF THE INVENTION AND RELATED ART

The present invention relaxes to a charging apparatus employing a magnetic brush, and an image forming apparatus.

(1) Image Formation Process

There have been designed various electrophotographic or electrostatic image forming apparatuses. Here, however, the general structure and operation of a typical image forming apparatus will be described with reference to an image forming apparatus shown in FIG. 4.

As a copy start signal is inputted into the image forming apparatus shown in FIG. 4, a photosensitive drum 1 as an object to be charged (photosensitive member) is charged to a predetermined potential level by a corona type charging device 3. Meanwhile, an original G placed on an original placement platen 10 is scanned by a beam of light projected from a unit 9 comprising a lamp for illuminating the original, a short focal point lens array, and a CCD sensor. As the unit 9 scans the original G, the light from the unit 9 is reflected by the surface of the original G, and the reflected light is focused onto the CCD sensor by the short focal point lens array. The CCD sensor comprises a light receiving portion, a transferring portion, and an outputting portion. As the reflected light is received by the light receiving portion of the CCD sensor, the signals borne by the reflected light are converted into electric charges, which are sent to the transferring portion, from which they are sequentially sent to the outputting portion in synchronization with clock pulses. In the outputting portion, the electric charges are converted into voltage signals, are amplified, and are reduced in impedance. Then, they are outputted from the outputting portion of the CCD sensor. Then, the voltage signals (analog signals) are converted into digital signals by being subjected to one of the known image processing sequences. The thus obtained digital signals (image formation signals) are sent to a printing portion of the image forming apparatus. In the printing portion, an exposing means 2 as an image writing means, which employs LEDs as light emitting means, is turned on or off in response to the digital image formation signals. As a result, an electrostatic latent image reflecting the original is formed on the peripheral surface of the photosensitive drum 1.

Next, the electrostatic latent image is developed by a developing device 4 as a developing means, which contains particles of toner. As a result, a toner image is formed on the peripheral surface of the photosensitive drum 1.

Then, the toner image on the photosensitive drum 1 is electrostatically transferred onto transfer medium by a transferring apparatus 7 as a transferring means. Thereafter, the transfer medium is electrostatically separated from the photosensitive drum 1, and is conveyed to a fixing device 6, in which the image (unfixed) on the transfer medium is thermally fixed to the transfer medium. Then, the transfer medium is outputted from the image forming apparatus.

The portion of the peripheral surface of the photosensitive drum 1, from which the toner image has just been transferred away, is cleared by a cleaner 5 of adhesive contaminants such as the toner remaining thereon, and is exposed, as necessary, to a pre-exposing means 8, which is for erasing the photonic memory left by the preceding image formation exposure, in order to be used again for image formation.

Regarding the method for removing the toner remaining on the peripheral surface of the photosensitive drum 1 after the toner image transfer (which hereinafter will be referred to simply as residual toner), there is a cleaner-less residual toner removal system, which does not employ a cleaner (5), and removes the residual toner in a developing device, during a process in which a latent image is developed.

(2) Photosensitive Member Based on a-Si

In the above-described image formation process, an organic photosensitive member, amorphous silicon based photosensitive member (which hereinafter will be referred to as a-Si photosensitive member), etc., in particular, an a-Si photosensitive member, are popularly used. An a-Si photosensitive member is high in surface hardness, and is highly sensitive to semiconductor laser beam, and the like. In addition, its deterioration resulting from repetitive usage is negligible. Therefore, an a-Si photosensitive member is widely used in the field of such an electrophotographic image forming apparatus as a high speed copying machine, a laser beam printer (LBP), etc.

An a-Si photosensitive member, however, is problematic in that it tends to be slightly nonuniformly charged, with the presence of a difference in potential level in the range of several tens of volts between the highest and lowest voltage points. This problem occurs for the following reason.

That is, an a-Si photosensitive member is manufactured by forming a film of a-Si on the peripheral surface of an aluminum cylinder by depositing a-Si plasma created by the superheating a-Si with high frequency waves or microwaves. Thus, unless the plasma is uniform, the a-Si film becomes nonuniform in composition in terms of both the lengthwise and circumferential directions of the aluminum cylinder, as it is formed. This compositional nonuniformity results in the nonuniformity in electrostatic capacity, which causes the peripheral surface of the photosensitive drum 1 to become nonuniformly charged as described above. Further, this nonuniformity in the thickness and composition of the a-Si film also affects the attenuation of the charge of a given area of the peripheral surface of the photosensitive member, which occurs between the pre-exposure for erasing the photonic memory effected during the preceding image forming rotations, that is, while the given area is not exposed to light (which hereinafter may be referred to as non-exposure potential attenuation), and the development process. Consequently, the nonuniformity in potential level is exacerbated, due to the nonuniformity in the thickness and/or composition of the photosensitive layer, by the time the given area reaches the development station.

As for the method for solving the above-described problem, it is effective to charge the photosensitive drum 1 two or more times, for the following reason. That is, the photonic memory from the preceding image forming rotations of the photosensitive drum 1 can be substantially reduced by the first charging process. Therefore, after the photosensitive drum 1 is subjected to the second charging process, the non-exposure potential attenuation will be substantially smaller. Therefore, the image defects attributable to the photonic memory (ghost) and/or nonuniformity in potential level will be far less likely to occur.

(3) Magnetic Brush Based Charging Device

As for the methods for charging an a-Si photosensitive drum, there are a corona based charging method which utilizes corona discharge, a roller based charging device which employs an electrically conductive roller to charge an object by utilizing the direct discharge between the roller and object, a charge injection based charging method which charges an object by directly injecting electric charge into the peripheral surface of a photosensitive member, with the use of such a charge injecting means as a magnetic brush formed of magnetic particles capable of contacting the surface of the object to be charged, across the large area thereof than a roller based charging device, and the like methods.

Among the above-listed charging methods, a corona based charging method and a roller based charging method utilize electric discharge to charge an object. Therefore, when these two charging methods are employed, by-products of electric discharge tend to adhere to the surface of the object to be charged. Further, the surface of an a-Si photosensitive member is very hard, being therefore not likely to easily wear. Therefore, once the by-products of electric discharge adhere to the surface of an a-Si photosensitive member, they tend to remain thereon. This presence of the by-products of electric discharge on the surface of an a-Si photosensitive member creates the following problem. That is, if an a-Si photosensitive member, the peripheral surface of which is contaminated with the by-products of electric discharge, is used under the high humidity condition, water vapor condenses on the peripheral surface of the a-Si photosensitive member, allowing the electric charge, of which the electrostatic latent image on the a-Si photosensitive member is formed, to transfer across the peripheral surface of the a-Si photosensitive member in the direction of the plane of the peripheral surface of the a-Si photosensitive member, resulting in the formation of an image which appears as if it has been smeared.

In comparison, the above-mentioned injectional charging method is such a charging method that directly injects electric charge into a photosensitive drum through the contact area between the peripheral surface of the photosensitive drum and the charging means, instead of primarily relying on electric discharge. Therefore, it is not likely to cause the above-mentioned problem that an image which appears smeared is formed. In addition, the injectional charging method (which hereinafter will be referred to simply as charge injection) is higher than the electric discharge based charging method, in charging performance as well as potential level convergence. Therefore, the employment of an injectional charging method substantially improves an image forming apparatus in terms of the image defects attributable to the phenomenon that the peripheral surface of a photosensitive drum is nonuniformly charged due to the photonlic memory and/or nonuniformity of the photosensitive layer of an a-Si photosensitive member.

One of the charging devices which employs the charge injecting method is a charging device which employs a magnetic brush formed of magnetic particles. The usage of magnetic particles by this charging device (which hereinafter may be referred to as magnetic brush based charging device) makes this charging device greater than the charging devices of other types, in the ratio of the contact area between the charging means and the photosensitive drum relative to the entire peripheral surface of the photosensitive drum. Therefore, it makes a charging apparatus more resistant to contamination. Further, unlike a charge roller as a charging means, the electrical resistance of a magnetic brush is not siubstantially increased by the conduction of electricity, prolonging thereby the service life of a charging device.

For the above-described reasons, charging methods which employ a plurality of magnetic brush based charging devices in order to charge an a-Si photosensitive member have been proposed.

However, the employment of two or more magnetic brush based charging devices substantially increases charging device cost, because a magnetic brush based charging device comprises a plurality of expensive components such as a magnetic roller. Therefore, a magnetic brush based charging device is desired to be substantially longer in replacement interval than an ordinary charging apparatus, that is, a charging device which does not employ a magnetic brush. Incidentally, when a magnetic brush based charging apparatus is employed to charge an a-Si photosensitive member, that is, an object which is highly durable, it is possible to reduce the cost for running an apparatus by taking advantage of the superb durability of an a-Si photosensitive member by making more durable the components disposed around the photosensitive member.

As described above, a magnetic brush based charging device, that is, a charging device which uses a magnetic brush formed of magnetic particles, is greater than such a contact type charging device as a roller based charging device, in terms of the ratio in size of the contact area between an object to be charged, and charging means, relative to the entirety of the peripheral surface of the object (photosensitive drum) to be charged, being therefore more resistant to contamination than a contact type charging device. Further, unlike the electrical resistance of a charge roller type charging device or the like, the electrical resistance of a magnetic brush based charging device is not substantially increased by the passage of electricity. Therefore, a magnetic brush based charging device is longer in service life than the charging devices of the other types. However, as a magnetic brush based charging device is used, developer and toner mix into the magnetic powder which forms the magnetic brush, and with the increases in cumulative usage, the amount of the developer and toner in the magnetic powder becomes substantial, because even if an image forming apparatus is provided with a cleaner, a small amount of developer (or toner) escapes the cleaner. As a result, the magnetic particles become contaminated across their surfaces, being thereby reduced in charging performance, although very gradually.

According to the prior art, therefore, in order to prevent the problem that a magnetic brush based charging device gradually reduces in charging performance with the increase in the cumulative usage thereof, the level of magnetic particle contamination is detected based on the amount of electric current which flows between a charging member and an object to be charged, and then, the magnetic particles are replaced based on the detected level of the magnetic particle contamination, in order to keep the charging performance of a magnetic brush based charging device within a predetermined range.

However, in the case of a magnetic brush based charging method in accordance with the prior art, such as the above-described one, for example, the one disclosed in Japanese Laid-open Patent Application 11-149204, the amount of the electric current which flows between a charging member and an object to be charged is measured. Therefore, the measurement is affected by the thickness of the surface layer of an object to be charged, the level of surface contamination of the object to be charged, the ambience, etc., making it difficult to precisely detect the level of magnetic particle contamination alone. Therefore, it is impossible to detect the local contamination of the body of magnetic particles.

Further, if an attempt is made to detect only the magnetic particle contamination using the method disclosed in Japanese Laid-open Patent Application 11-149204, a dedicated electrode for measuring the amount of the electric current which flows through the body of magnetic particles is required in addition to the electrode for measuring the amount of the afore-mentioned electric current which flows between a charging member and an object to be charged. This adversely affects cost reduction.

The present invention relates to a charging apparatus and an image forming apparatus, which do not suffer from the above-described problem.

SUMMARY OF THE INVENTION

The primary object of the present invention is to precisely detect the level of magnetic particle contamination, by measuring the amount of the electric current which flows through the body of magnetic particles.

Another object of the present invention is to reduce the cost of a magnetic brush based charging apparatus, by eliminating the need for a dedicated electrode for the measurement of the amount of the electric current which flows through the body of magnetic particles.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS (Embodiment 1)

Figure 1:
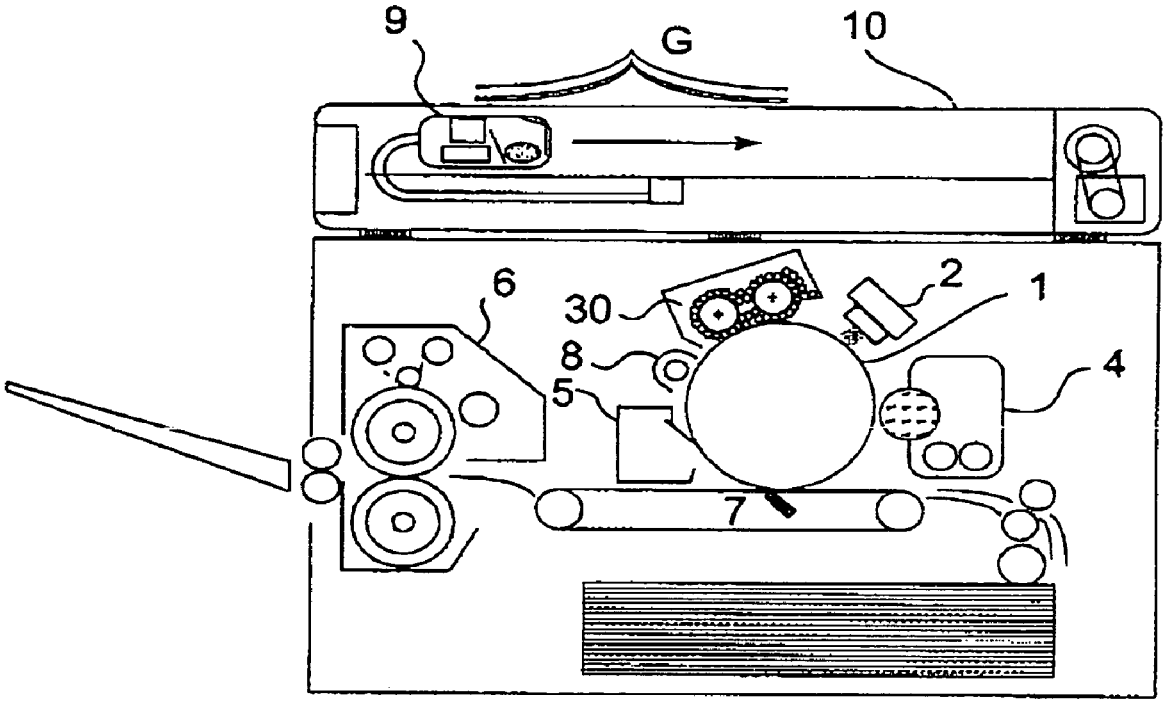
FIG. 1 is a schematic sectional view of an image forming apparatus identical to the image forming apparatuses in the first, second, and third embodiments of the present invention.

Referring to FIG. 1, the charging apparatus in this embodiment will be described regarding the general structure and operation thereof.

As a copy start signal is inputted into the image forming apparatus shown in FIG. 1, the photosensitive drum 1 (image bearing member) as an object to be charged is charged to a predetermined potential level by the magnetic brush of the magnetic brush based charging apparatus 30, which is formed of magnetic particles and is placed in contact with the photosensitive drum 1. Meanwhile, an original G placed on an original placement platen 10 is scanned by a unit 9 comprising a light for illuminating the original, a short focal point lens array, and a CCD sensor. As the unit 9 scans the original, the light from the unit 9 is reflected by the surface of the original, and the reflected light is focused onto the CCD sensor by the short focal point lens array. The CCD sensor comprises a light receiving portion, a transferring portion, and an outputting portion. As the reflected light is received by the light receiving portion of the CCD sensor, the signals carried by the reflected light are converted into electric charges, which are sent to the transferring portion, from which they are sequentially sent to the outputting portion in synchronization with clock pulses. In the outputting portion, the electric charges are converted into voltage signals, are amplified, and are reduced in impedance. Then, they are outputted from the outputting portion of the CCD sensor. Then, the voltage signals (analog signals) are converted into digital signals by being subjected to one of the known image processing sequences. The thus obtained digital signals (image formation signals) are sent to a printing portion of the image forming apparatus. In the printing portion, an exposing means 2 as an image writing means, which employs LEDs as light emitting means, is turned on or off in response to the digital image formation signals. As a result, an electrostatic latent image reflecting the original is formed on the peripheral surface of the photosensitive drum 1.

Next, the electrostatic latent image is developed by a developing device 4 as a developing means, which contains particles of toner. As a result, a toner image is formed on the peripheral surface of the photosensitive drum 1.

Then, the toner image on the photosensitive drum 1 is electrostatically transferred onto transfer medium by a transferring apparatus 7 as a transferring means. Thereafter, the transfer medium is electrostatically separated from the photosensitive drum 1, and is conveyed to a fixing device 6, in which the image (unfixed) on the transfer medium is thermally fixed to the transfer medium. Then, the transfer medium is outputted from the image forming apparatus.

The portion of the peripheral surface of the photosensitive drum 1, from which the toner image has just been transferred away, is cleared by a cleaner 5 of adhesive contaminants such as the toner remaining thereon, and is exposed, as necessary, to a pre-exposing means 8, which is for erasing the photonic memory left by the preceding image formation exposure, in order to use the portion again for image formation. Regarding the method for removing the toner remaining on the peripheral surface of the photosensitive drum 1 after the toner image transfer (which hereinafter will be referred to simply as residual toner), there is a cleanerless residual toner removal system, which does not employ a cleaner (5), and removes the residual toner in a developing device, during a process in which a latent image is developed.

Among the above-described structural components of the image forming apparatus, that is, photosensitive drum 1, charging means, developing means, cleaning means, etc., two or more of them may be integrated into a process cartridge by integrally placing them in a cartridge removably mountable in the main assembly of an electrostatic latent image such as a copying machine, a laser beam printer, etc. For example, one among the structural components of the magnetic brush based charging apparatus 30 in this embodiment, that is, developing means, and cleaning means, and the photosensitive drum 1, may be integrated into a process cartridge (they may be integrally supported in a cartridge removably mountable in apparatus main assembly), which can be removably mountable in the main assembly of an image forming apparatus along such a guiding means as a pair of rails with which the main assembly is provided.

Figure 2:
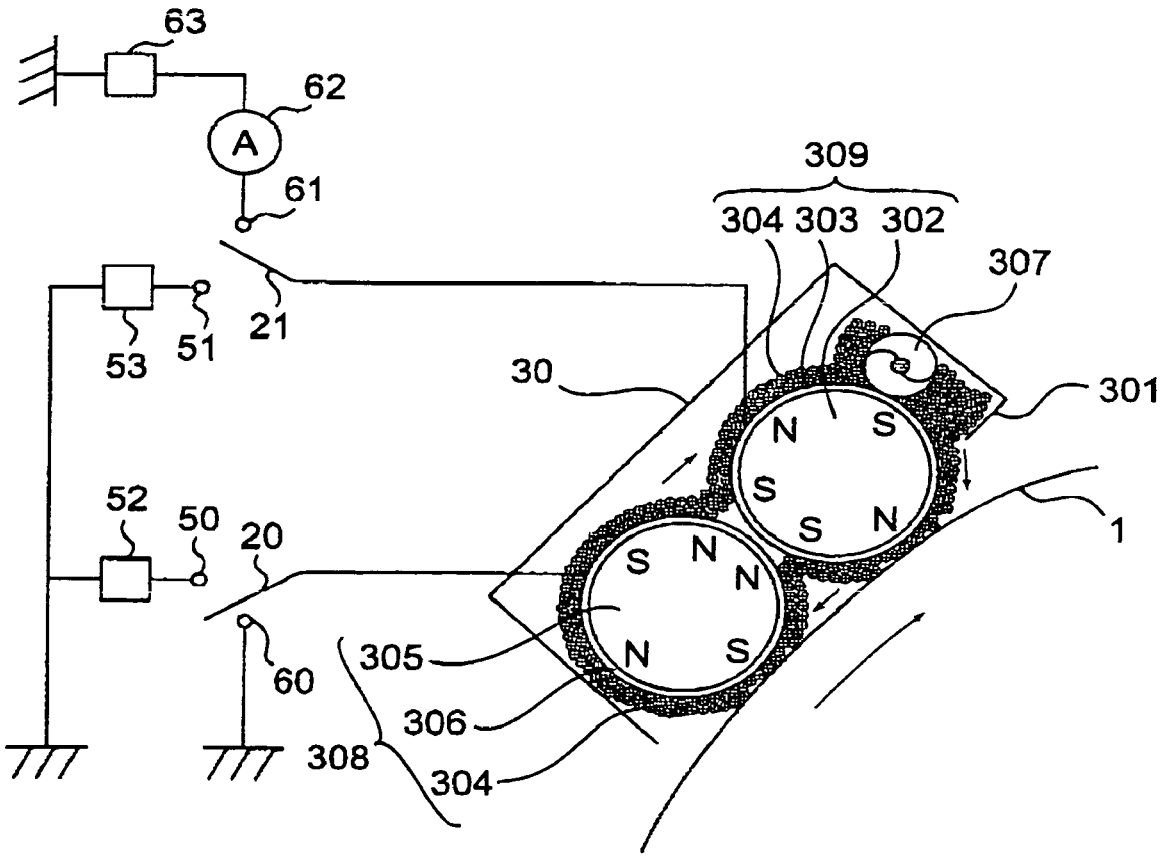
FIG. 2 is a schematic sectional view of the magnetic brush based charging device in the first embodiment of the present invention.

Next, the charging process will be described. The charging apparatus in this embodiment is a magnetic brush based charging apparatus, which is used for charging a photosensitive member which uses amorphous silicon, as photosensitive material, the inherent polarity of which is positive. Referring to FIG. 2, the charging apparatus comprises a housing, first and second magnetic particle bearing members, and magnetic particles. The first and second magnetic particle bearing members and magnetic particles are contained in the housing, with the magnetic particles shared by the first and second magnetic particle bearing members. The magnetic particles borne on the peripheral surface of the first magnetic particle carrying member, and the magnetic particles borne on the peripheral surface of the second magnetic particle bearing member, form a pair of contact areas (nips), one for one, against the peripheral surface of a photosensitive member.

Figure 5:
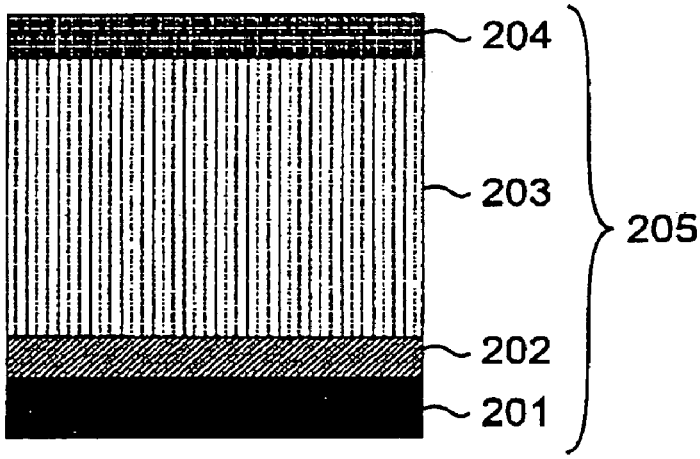
FIG. 5 is a schematic sectional view of the photosensitive layer of a typical amorphous silicon type photosensitive member, showing the general structure thereof.

FIG. 5 is a schematic sectional view of the photosensitive layer of the a-Si type in this embodiment, showing the structure thereof.

The a-Si photosensitive member shown in FIG. 5 comprises: an electrically conductive substrate 201 formed of aluminum or the like substance; a photosensitive layer 205 (comprising a plurality of sub-layers: charge injection prevention layer 202 and photo-conductive layer 203 which exhibits photoconductivity); and a surface layer 204. The electric charge injection prevention layer 202 is for preventing electric charge from being injected from the electrically conductive substrate 201 into the photoconductive layer 203, and is provided as necessary. The photoconductive layer 203 is formed of an amorphous material which contains at least silicon atoms, and exhibits photoconductivity. The surface layer 204 contains silicon atoms and carbon atoms (in addition, hydrogen atoms or halogen atoms, or both, as necessary), and is capable of bearing a latent image formed in an electrophotographic apparatus.

An a-Si photosensitive member is manufactured by forming a film of a-Si on the peripheral surface of an aluminum cylinder by depositing a-Si plasma created by the superheating a-Si with high frequency waves or microwaves. Thus, unless the plasma is uniform, the a-Si film becomes nonuniform in thickness as well as composition, as it is formed. This compositional and thickness nonuniformity results in the nonuniformity in electrostatic capacity, in the range of roughly 10 V, which causes the peripheral surface of the photosensitive drum 1 to become nonuniformly charged as described above. Further, this nonuniformly in the thickness and composition of the a-Si film also affects the attenuation of the charge of a given area of the peripheral surface of the photosensitive member, which occurs between the pre-exposure for erasing the photonic memory effected during the preceding image forming rotations, that is, while the given area is not exposed to light (which hereinafter may be referred to as non-exposure potential attenuation), and the development process. Consequently, the nonuniformity in potential level is exacerbated, due to the nonuniformity in the thickness and/or composition of the photosensitive layer, by the time the given area reaches the development station.

At this time, the above-mentioned photonic memory will be described. As a given point of the peripheral surface of a charged a-Si photosensitive member is exposed to the image formation light, photonic are generated, reducing thereby the potential level of this point. However, an a-Si photosensitive member has numerous tangling bonds, which act as local simular potentials, which capture some of photonic carriers, reducing thereby the movement of the photonic carriers, or reduces the recombination probability of photonic carriers. Thus, as soon as an a-Si photosensitive member is subjected to the electric field during the following rotation of the a-Si photosensitive member, the part of the photonic carriers generated by the exposure and captured by the local simular potentials are released from the local simular potential, making thereby the numerous points of the peripheral surface of the a-Si photosensitive member, which were exposed during the preceding image forming rotations of the a-Si photosensitive member, different in potential level from the unexposed points, that is, the rest of the points of the peripheral surface of the a-Si photosensitive member, Consequently, an photonic memory is created.

Thus, generally, the photonic memory of the portion of the peripheral surface of the a-Si photosensitive member, which has just been used for image formation is erased by uniformly exposing the portion having the photonic memory, in the pre-exposure process so that the portion becomes internally overloaded with photonic carriers. The efficiency with which the photonic memory is erased in this pre-exposure process can be enhanced by increasing the amount of the light emitted from the pre-exposure light source 8, making the wavelength of the pre-exposure light as close as possible to a value in the wavelength range (680–700 nm) at which the a-Si photosensitive member is highest in sensitivity, or the like means.

However, when the photosensitive layer of an a-Si photosensitive member is nonuniform in thickness as described above, the photoconductive layer of the a-Si photosensitive member becomes nonuniform in the strength of the electric field to which it is subjected, becoming therefore nonuniform in the amount by which the photonic carriers are released from the above-mentioned local simular potentials. More specifically, the thinner the photoconductive layer, the greater the potential attenuation of the layer. Thus, even if the a-Si photosensitive member is uniformly charged, the uniformly charged portion of the a-Si photosensitive member becomes nonuniform in potential level by the time this portion reaches the developing station. Moreover, the thinner the photoconductive layer, the greater the electrostatic capacity thereof, and therefore, the lower the chargeability thereof. The lower the chargeability, the more conspicuous the level of nonuniformity in potential level which materializes by the time the charge portion reaches the development station. This nonuniformity in potential level survives the exposure process, and is distinctively visible as density anomaly, in particular, across the low density areas of an image, after the development process.

Further, even when the photosensitive layer of an a-Si photosensitive member is uniform in thickness, it is not always uniform in composition in terms of the circumferential and lengthwise direction of the photosensitive member. This problem is attributable to the method used for manufacturing an a-Si photosensitive member. If the photosensitive layer of an a-Si photosensitive member is nonuniform in composition, it is nonuniform in the amount by which photonic carriers are generated in the photosensitive layer. Therefore, it becomes nonuniform in the non-exposure potential attenuation. As a result, it becomes nonuniform in potential level by the time it reaches the development station.

One of the methods for reducing the amount of the non-exposure potential attenuation, and the nonuniformity in potential level attributable to the nonuniformity in the thickness and/or composition of the photosensitive layer of an a-Si photosensitive member, is to charge an a-Si photosensitive member twice. That is, the first charging process substantially reduces photonic carriers, and therefore, the amount by which the non-exposure potential attenuate which occurs after the second charging process is substantially smaller. Therefore, the possibility that an image suffering from the ghosts attributable to the nonuniformity in potential level of an a-Si photosensitive member will be substantially smaller.

As for the charging means for charging the above-mentioned a-Si photosensitive member, an apparatus which utilizes corona discharge has been put to practical use. However, the relative dielectric constant of an a-Si photosensitive member is in the range of 11–12, which is relatively large, making thereby the a-Si photosensitive member relatively large in electrostatic capacity, compared to an organic photosensitive member. Therefore, compared to an organic photosensitive member, an a-Si photosensitive member is more susceptible to the problems that it is more difficult to charge, and that it is more likely to form an image which appears smeared, because it is more likely to allow the electric charge, of which a latent image is formed, to be transferred by electric discharge.

In comparison, when an electrically conductive roller, a fur brush, a magnetic roller on which magnetic particles are borne, or the like is employed as the charging member for charging an a-Si photosensitive member, in other words, when a contact type charging member capable of assuring satisfactory contact between a charging member and a photosensitive member, is used to charge an a-Si photosensitive member, it is possible to charge the photosensitive member to a potential level virtually the same as that of the DC component of the bias applied to the contact charging member, because the surface layer of an a-Si photosensitive member is formed of a substance, the resistivity of which is in the range of $10^9$–$10^{14}$ Ω·cm. In a charging method such as this charging method, electric charge is directly injected into a photosensitive member to charge it. Therefore, this charging method is called the injectional charging method. An injectional charging method does not utilizes electric discharge, which is utilized by a corona type charging device to charge an image bearing member. Therefore, it is completely ozone free, and also, smaller in power consumption. Thus, it has begun to attract attention in recent years. In addition, an injectional charging method can prevent the reduction in the charging performance, and also, the formation of an image which appears smeared. Further, it makes it easier to control the potential level to which an a-Si photosensitive member is to be charged, because the potential level to which a photosensitive member is charged is very close to the potential level of the voltage applied to a charging means.

Next, referring to FIG. 2, the charging apparatus in this embodiment, that is, a magnetic brush based charging apparatus 30, will be described. The magnetic brush based charging apparatus 30 is provided with first and second magnetic brush based charging devices 308 and 309. The magnetic brush based charging device 309 is located on the downstream side of the first magnetic brush based charging device 308 in terms of the moving direction of the peripheral surface of a photosensitive member. The two magnetic brush based charging devices 308 and 309 are provided with a first charging sleeve 306 as a first magnetic particle bearing member, and a second charging sleeve 303 as a second magnetic particle bearing member, respectively, which are positioned within the housing of the magnetic brush based charging apparatus 30. In the charging sleeves 303 and 306, magnets 302 and 305 as magnetic field generating means, which have five magnetic poles, are placed, respectively, so that magnetic particles 304 are made to crest in the form of a brush, on the peripheral surfaces of the charging sleeves 303 and 306, by the magnetic force from the magnets 302 and 305. In this embodiment, 200 g of magnetic particles are shared by the first and second charging sleeves 306 and 303. The charging apparatus is also provided with a current meter 62 as a means for measuring the amount of electric current, in order to measure the amount of electrical current which flows through the body of magnetic particles between the first and second charging sleeves 306 and 303.

In this embodiment, two charging sleeves are placed in a single container, or the housing of the charging apparatus 30, in which the magnetic particles are circularly moved to form two contact nips (magnetic brushes) between the two charging sleeves and the peripheral surface of the photosensitive member. Beside the charging method in this embodiment in which two charging sleeves are placed in a single container, there are other methods for charging a photosensitive member, at two points, using the magnetic brush based charging apparatus 30. For example, the two independent magnetic brush based charging devices may be used to charge a photosensitive member. However, the charging method in this embodiment makes it possible to place two magnetic particle bearing members close to each ether, making it thereby possible to reduce the space necessary for a two-point charging apparatus.

The magnets 302 and 305 each have multiple magnetic poles, which are alternately arranged in terms of the circumferential direction of a magnet, except in the area where the peripheral surfaces of the two charging sleeves 306 and 303 oppose each other, and where the two magnetic poles of each magnet are the same in polarity. Further, in this area, the first and second magnets are different in polarity. Positioning the magnets as described above improves the efficiency with which the magnetic particles 304 are conveyed between the two magnetic brush bearing members (charging sleeves 306 and 303). The magnetic particles 304 for charge injection confined by a magnetic particle regulating means 301 are made to crest in the form of a brush, by the magnetic field generated by the stationary magnets 302 and 305. Thus, as the charging sleeves 303 and 306 are rotated, the magnetic particles for charge injection are transferred between the two charging sleeves 303 and 306 while remaining crested by the magnetic field. The first and second charging sleeves 306 and 303 are rotated at a peripheral velocity of 250 mm/sec, in the direction counter to the rotational direction of the photosensitive drum 1, which is rotated at a peripheral velocity of 300 mm/sec. As voltage is applied to the first and second charging sleeves 306 and 303, electric charge is transferred to the peripheral surface of the photosensitive drum 1 from the magnetic particles 304 which are in contact with the peripheral surface of the photosensitive drum 1. As a result, the peripheral surface of the photosensitive drum 1 is charged to a potential level very close to that of the voltage applied to the charging sleeves 306 and 303.

In this embodiment, the amount by which the magnetic particles 304 are coated on the peripheral surface of each charging sleeve is 50 mg/cm$^2$. Generally, the amount by which the magnetic particles 304 are coated on the peripheral surface of each charging sleeve is desired to be in the range of 10 mg/cm$^2$–200 mg/cm$^2$. Preferably, it is desired to be in the range of 30 mg/cm$^2$–00 mg/cm$^2$ in consideration of the prevention of the phenomenon that while the magnetic particles on the peripheral surface of each charging sleeve are moved through the nips, some of them fail to remain confined, being thereby squeezed out of the nips.

The average particle diameter, saturation magnetization, and electrical resistance of the magnetic particles 304 for charge injection are desired to be in the ranges of 10–100 μm, 20–250 emu/cm$^3$, and $10^2$–$10^{10}$ Ω·cm, respectively. In consideration of the possibility that a photosensitive drum may have insulative defect such as a pinhole, the resistance of the magnetic particles 304 is preferred to be no less than $10^6$ Ω·cm. For the purpose of improving a charging apparatus in charging performance, the electrical resistance of the magnetic particles 304 is desired to be as small as possible. In this embodiment, therefore, such magnetic particles for charge injection that are 20 μm in average particle diameter, 200 emu/cm$^3$ in saturation magnetization, and $5\times10^6$ Ω·cm in electrical resistance are employed. Further, the magnetic particles for charge injection in this embodiment are obtained using a process in which ferrite is oxidized across the surface, and then, is reduced to adjust its electrical resistance.

The above-mentioned value of the electrical resistance of the magnetic particles 304 for charge injection was measured in the following manner: 2 g of the magnetic particles for charge injection were placed in a metallic cell with a bottom area size of 228 mm$^2$, and compacted with the application of a load of 6.6 kg/cm$^2$. Then, the resistance was measured while applying a voltage of 100 V.

When forming an image using an image forming apparatus employing the charging apparatus in this embodiment, change-over switches 20 and 21 are connected to charging circuit contacts 50 and 51, respectively. To the charging sleeve 306 as the first magnetic particle bearing member, 600 V of DC voltage is applied from a DC power source 52, and to the charging sleeve 303 as the second magnetic particle bearing member, 500 V of DC voltage is applied from a DC power source 53. As these voltages are applied, a given area of the peripheral surface of the photosensitive drum 1 is charged to a potential level close to 600 V in the charging nip between the photosensitive drum 1 and first charging sleeve 306. However, by the time the given area begins to be charged by the second charging sleeve 303, the potential level of the given area attenuates (non-exposure potential attenuation) to a level slightly lower than 500 V, because the photosensitive drum 1 is of the a-Si type. Then, as the given area is charged by the charging sleeve 303, it becomes uniformly charged, because the potential of the given area is already at a level slightly lower than 500 V, and therefore, the length of time it takes for the given area to be moved through the charging nip between the second charging sleeve 303 and photosensitive drum 1 is long enough for the potential level of the given area to converge to a potential level virtually the same as that of the voltage applied to the second charging sleeve 303. Further, the photonic carriers can be substantially reduced after the charging of the photosensitive drum 1 in the nip formed between the fist charging sleeve 306 and photosensitive drum 1. Therefore, the amount by which the non-exposure potential attenuation occurs after the charging of the photosensitive drum 1 by the second charging sleeve 303 can be substantially reduced. Consequently, the nonuniformity in potential level attributable to the nonuniformity in the non-exposure potential attenuation, the nonuniformity in potential level attributable to the erroneous charging, and the like nonuniformity in potential level, can be substantially reduced.

Figure 6:
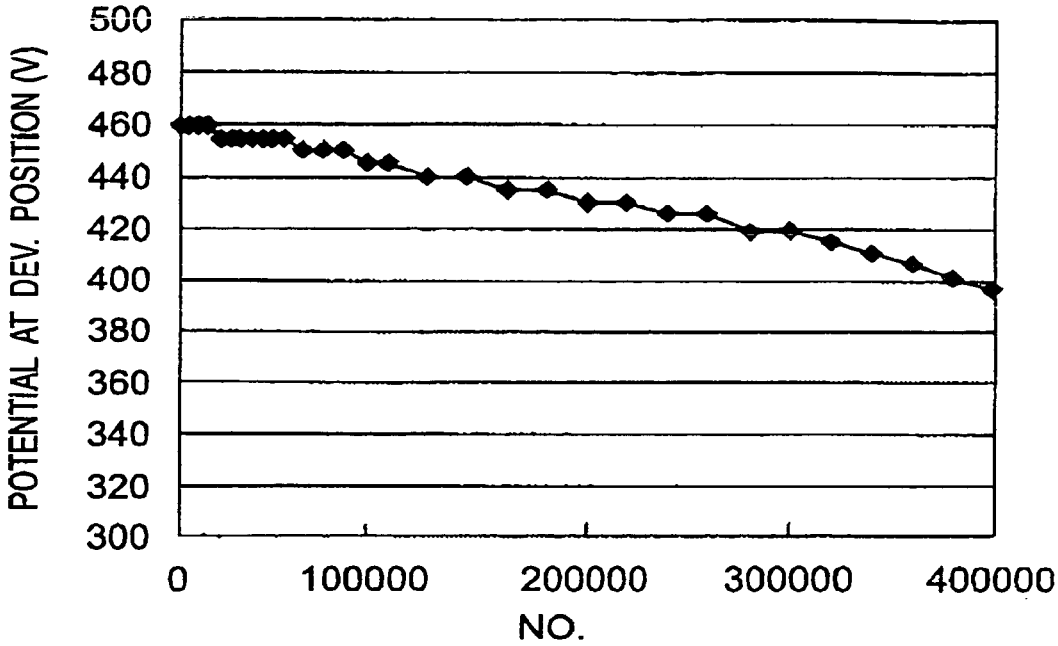
FIG. 6 is a graph showing the changes in the potential level to which the photosensitive drum became charged, which occurred when the magnetic particles were not replaced, in the first embodiment.
Figure 7:
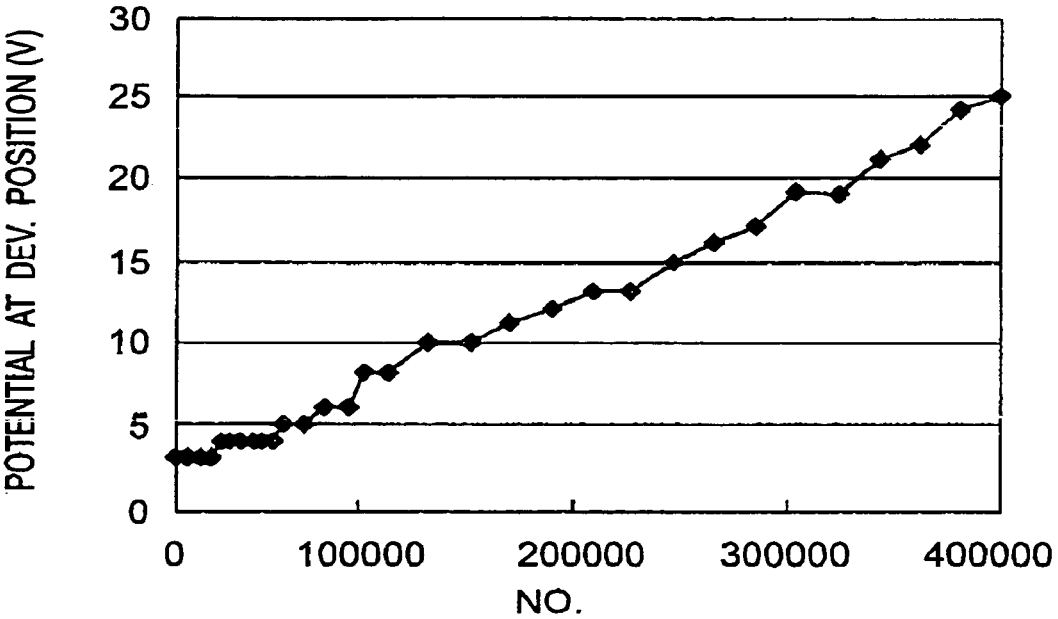
FIG. 7 is a graph showing the changes in the level of the nonuniformity in the potential level to which the photosensitive drum became charged, which occurred when the magnetic particles were not replaced, in the first embodiment.

FIG. 6 shows the changes in the potential level of the photosensitive drum 1 at the development station, which occurred when a large number of copies with an image ratio of 7% were continuously outputted under the above-described conditions. FIG. 7 shows the changes in the level of nonuniformity in potential level, which occurred when a large number of copies with an image ratio of 7% were continuously outputted under the above-described conditions.

As will be evident from FIGS. 6 and 7, while the first to roughly 50,000th copies were made, the photosensitive drum 1 could be charged with no problem in terms of potential level as well as the uniformity thereof. However, after the formation of roughly 50,000 copies, the potential level, to which the photosensitive drum 1 became charged, gradually reduced, and also, the level of the nonuniformity in the potential level, to which the photosensitive drum 1 became charged, gradually increased, indicating that the charging performance of the charging apparatus gradually reduced.

When the electrical resistance of the magnetic particles 304 in the charging apparatus which had decreased in charging performance was measured using the above-described method, it was revealed that the electrical resistance of the magnetic particles 304, which initially was $5\times10^6$ Ω·cm, was $2\times10^7$ Ω·cm after the formation of 100,000 copies, indicating a substantial amount of increase in the electrical resistance of the magnetic particles 304. It may be reasonable to deduce from this that the increase in the electrical resistance of the magnetic particles attributable to the contamination of the magnetic particles is the primary cause of the decline in the charging performance of a magnetic brush based charging apparatus.

Thus, in this embodiment of the present invention, the charging apparatus 30 is structured so that the electrical resistance of the magnetic particles 304 can be easily measured while the magnetic particles 304 (charging apparatus 30) are in the main assembly of the image forming apparatus, and that the charging process can be controlled to prevent the increase in the electrical resistance of the magnetic particles 304 from affecting image formation First, during one of the operational periods in which no image is actually formed (which hereinafter will be referred to simply as non-image formation period), a difference in potential level is provided between the first and second charging sleeves 306 and 303, and the electrical resistance of the magnetic particles 304 is obtained by measuring the current which flows through the magnetic particles 304. More specifically, during one of the non-image formation periods, the rotation of the photosensitive drum 1 is stopped, and the change-over switches 20 and 21, shown in FIG. 2, are switched in connection from the charging circuit contacts 50 and 51 to the current amount measurement circuit contacts 60 and 61, setting up the current amount measurement circuit, which comprises a current amount measurement DC power source 63 and a current meter 62 as a current amount measuring means, and is enabled to measure the amount of the current which flows through the body of the magnetic particles between the first and second charging sleeves 306 and 303. When the photosensitive drum 1 is not being rotated, current does not flow from the magnetic brush based charging apparatus to in the photosensitive drum 1, making it possible to directly measure the amount of the current which flows through the body of magnetic particles between the two charging sleeves 306 and 303. Since the amount of the current which flows through the body of magnetic particles can be directly measured, the level of the magnetic particle contamination can be precisely detected. Further, according to this embodiment, a part of the charging circuit is shared by the current amount measurement circuit, making it unnecessary to provide the charging sleeves 306 and 303 with a dedicated probe for measuring the amount of the current which flows through the body of magnetic particles between the two charging sleeves 306 and 303, accomplishing thereby cost reduction.

Figure 3:
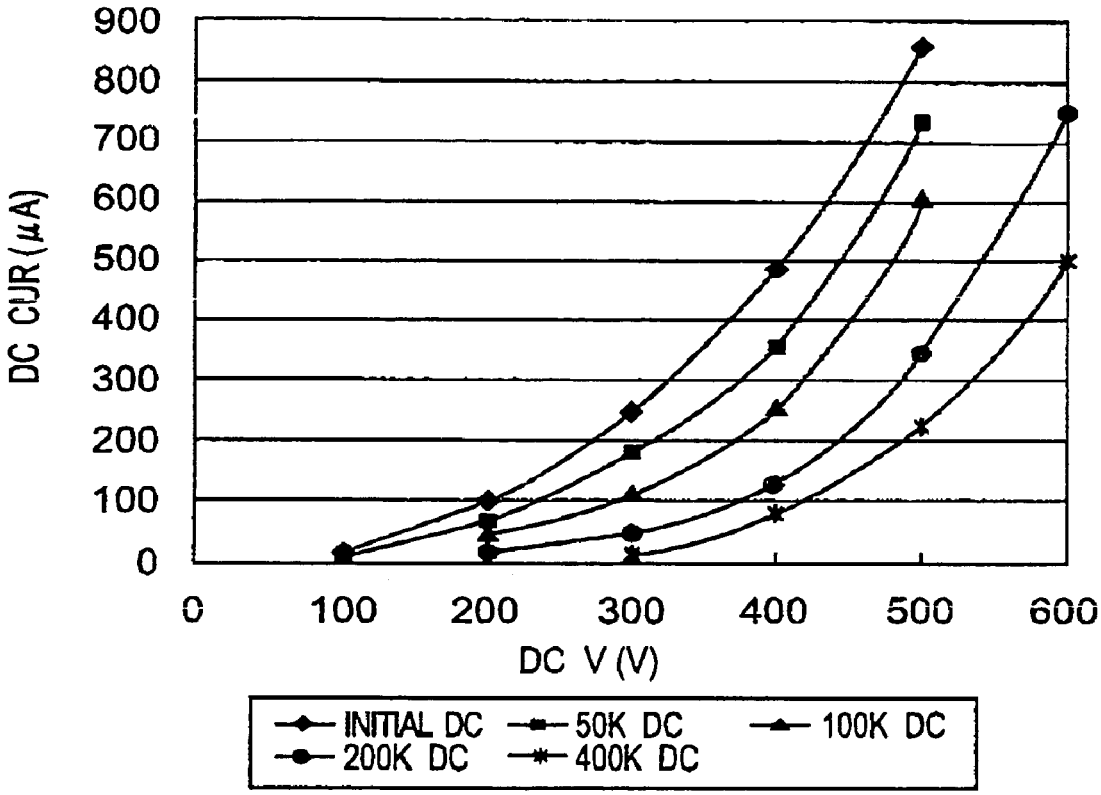
FIG. 3 is a graph showing the changes in the amount of the electric current which flowed through the body of magnetic particles, which occurred as the cumulative number of copies made by the image forming apparatus increased.
Figure 4:
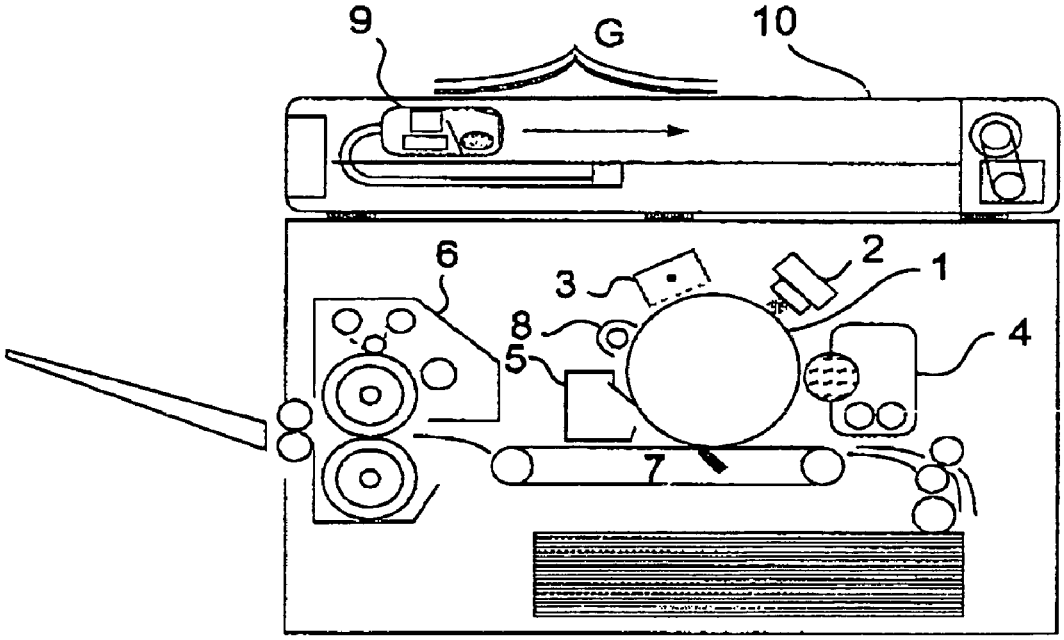
FIG. 4 is a schematic sectional view of a typical image forming apparatus in accordance with the prior art.

FIG. 3 is a graph showing the amounts of the current which flowed through the body of magnetic particles between the first and second charging sleeves 306 and 303, as DC voltages in the range of 0–600 V are applied to the second charging sleeve 303 with the first charging sleeve 306 grounded, and which were measured after the formation of $50{,}000^{th}$, $100{,}000^{th}$, $200{,}000^{th}$, and $400{,}000^{th}$ copies. As will be evident from FIG. 3, with the increase in the cumulative number of printed copies, the electrical resistance of the magnetic particles gradually increased, gradually decreasing thereby the amount of the current.

Thus, in this embodiment, the above-described process for obtaining the value of the electrical resistance of the magnetic particles by measuring the amount of the current which flows through the body of magnetic particles between the first and second charging sleeves 306 and 303, as a predetermined amount of difference in potential level is provided between the first and second charging sleeves 306 and 303, is carried out when the power source of the main assembly of an electrophotographic apparatus is turned on, and when $1{,}000^{th}$ recording medium is ready to be fed into the image assembly.

More specifically, immediately after the power source for the main assembly of an electrophotographic apparatus is turned on, and when $1{,}000^{th}$ recording medium is ready to be fed into the main assembly, the connection of the change-over switches 20 and 21 are switched from the charging circuit contacts 50 and 51 to the current amount measurement circuit contacts 60 and 61, to set up the current amount measurement circuit. Then, the amount of the current is monitored with the use of a current meter 62 as a current amount measuring means, while applying various DC voltages, the potential levels of which are in the range of 6–600 V, to the second charging sleeve 303, with the first charging sleeve 306 grounded. By measuring the current amount multiple times while varying the mount of the difference in potential level between the first and second charging sleeves 306 and 303, the measurement accuracy can be improved. Although in this embodiment, the current amount is measured multiple times while varying the amount of the difference in potential level between the first and second charging sleeves 306 and 303, the number of times the current amount is measured does not need to be limited to multiple times; it may be only once. Then, as the current amount measured by the current meter becomes, for the first time, smaller than the current value corresponding to the $50{,}000^{th}$ copy in FIG. 3, it is determined that it is the time for magnetic particle replacement. Then, the magnetic particles in the housing of the charging apparatus, that is, the used magnetic particles, is removed by roughly 10 g from the housing by a screw 307 as a magnetic particle replacing means, and is sent to an unshown magnetic particle recovery container. Then, the charging apparatus is supplied with 10 g of fresh magnetic particles from an unshown magnetic particle supply container, ending the magnetic particle replacement process.

Figure 8:
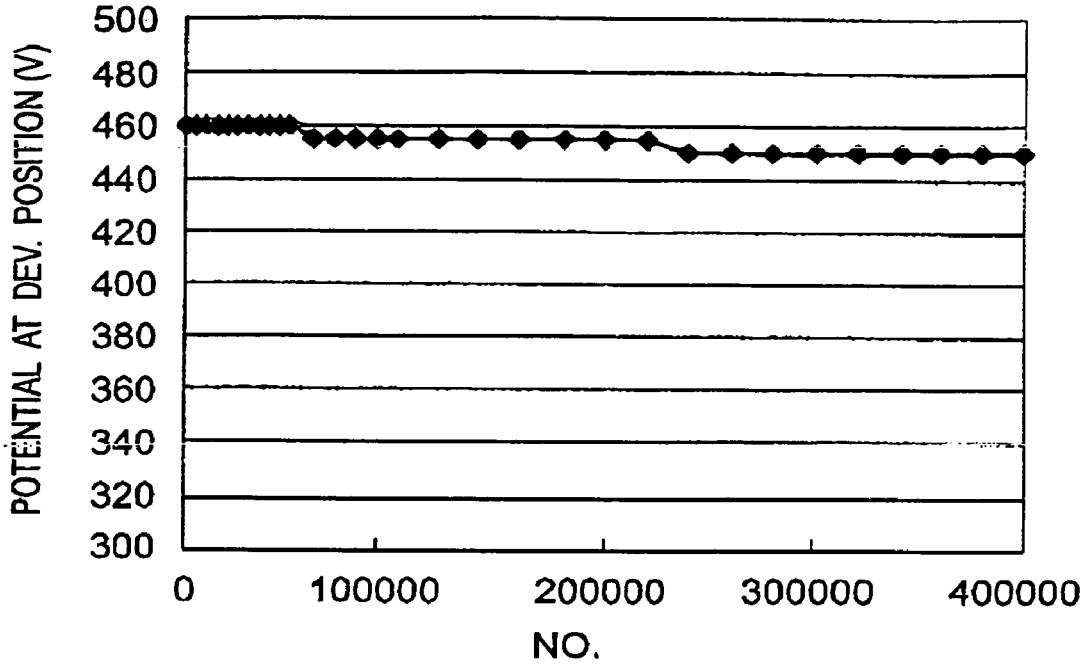
FIG. 8 is a graph showing the changes in the potential level to which the photosensitive drum became charged, which occurred when the magnetic particles were replaced, in the first embodiment.
Figure 9:
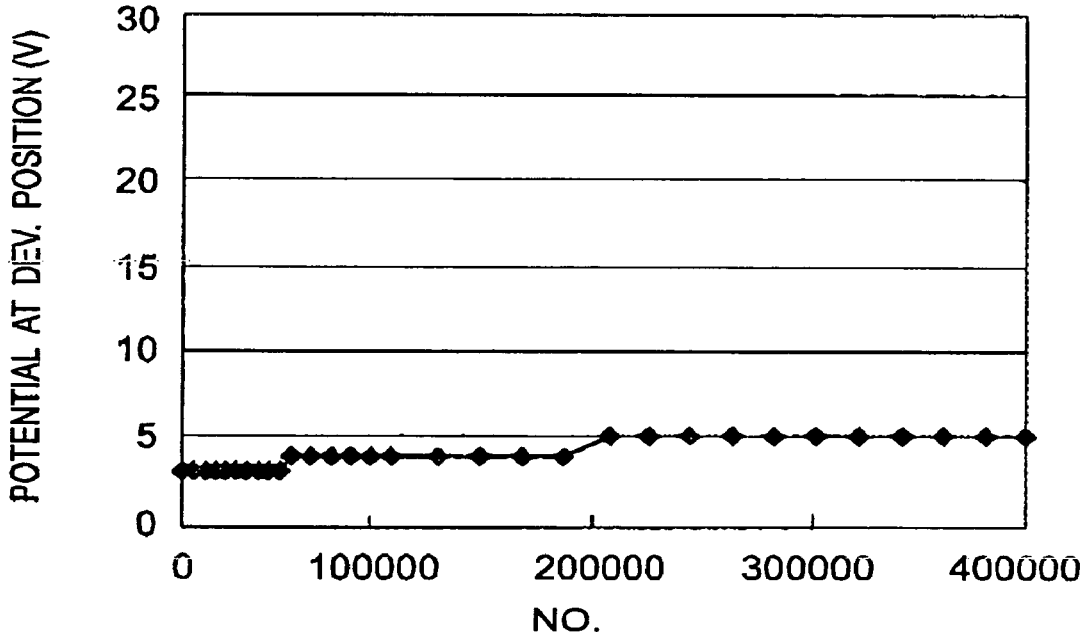
FIG. 9 is a graph showing the changes in the level of the nonuniformity in the potential level to which the photosensitive drum became charged, which occurred when the magnetic particles were replaced, in the first embodiment.

As described above, by replacing a part of the used magnetic particles with a supply of fresh magnetic particles in response to the magnetic particle contamination, the level of which is determined by measuring the electrical resistance of the magnetic particles, it is possible to prevent the performance of the charging apparatus from falling below a predetermined level, in order to maintain the potential level to which the photosensitive drum becomes charged, at a preferable value, and also, the level of nonuniformity of the potential level to which the photosensitive drum becomes charged, at a preferable value, for a long period. FIG. 8 shows the changes in the potential level of the photosensitive drum at the developing station, which occurred as a large number of copies with an image ratio of 7% were continuously made under the above described condition in this embodiment. FIG. 9 shows the changes in the level of nonuniformity in the potential level to which the photosensitive drum became charged, which occurred under the same conditions as those under which the results shown in FIG. 6 were obtained. As will be evident from FIGS. 8 and 9, the potential level to which the photosensitive drum became charged, and the level of nonuniformity in the potential level to which the photosensitive drum became charged, remained within the preferable ranges; they did not worsen as shown in FIGS. 6 and 7.

The amount by which the used magnetic particles are to be replaced with fresh magnetic particles does not need to be limited to 10 g, by which the used magnetic particles are replaced in this embodiment. In other words, the used magnetic particles may be more frequently replaced by a smaller amount, or less frequently by a larger amount.

Further, in this embodiment, the level of the magnetic particle contamination at or above which the magnetic particles are to be replaced is set to the value corresponding to the current value at the formation of $100{,}000^{th}$ copy. However, this requirement also is optional. In other words, if a user wants to keep the charging performance at a higher level, the user should increase the frequency with which the magnetic particles are replaced, whereas if the user wants reduce the replacement frequency, the user may set the level of the magnetic particle contamination, at which the magnetic particles are to be replaced, to a value bordering the occurrence of the above-mentioned image defects.

The timing with which the amount by which current flows through the body of magnetic particles between the two charging sleeves is measured to detect the level of magnetic particle contamination, is also optional. In other words, it may be after the formation of a predetermined number of copies, immediately after the power to the apparatus main assembly is turned on, etc.

(Embodiment 2)

Figure 19:
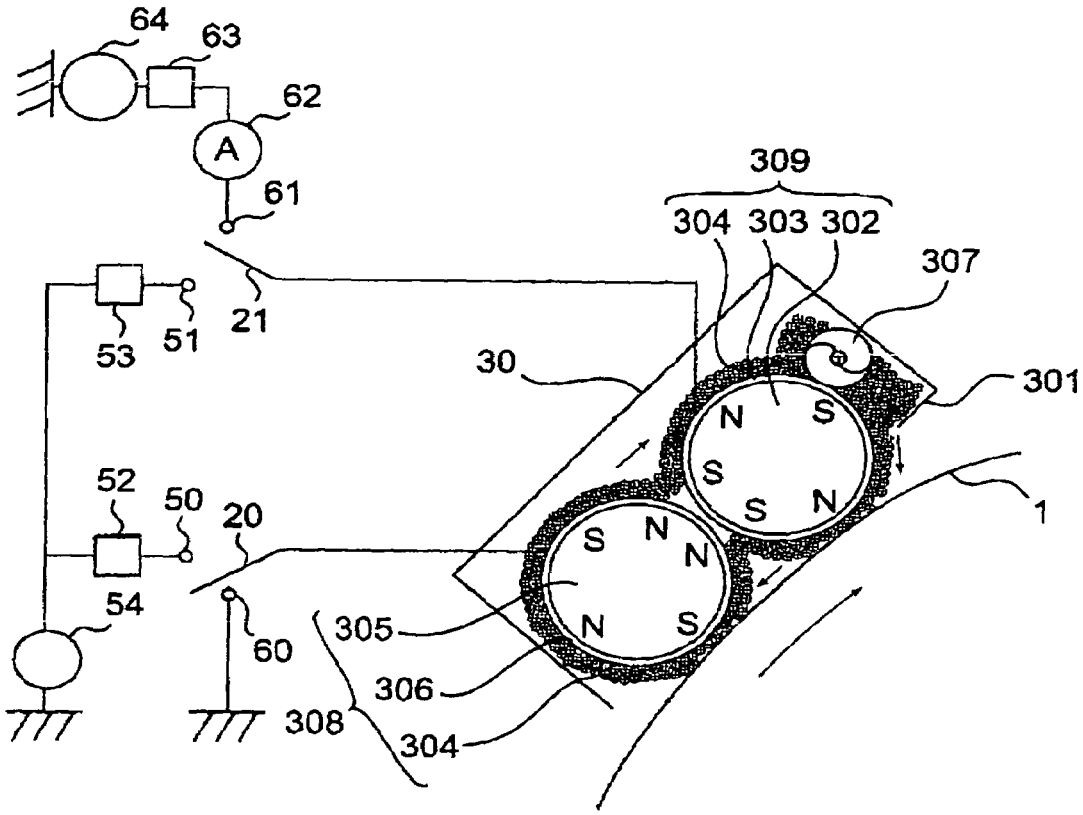
FIG. 19 is a schematic sectional view of the magnetic brush based charging device in the second embodiment of the present invention.

Referring to FIG. 19, in the second embodiment, in order to charge the photosensitive drum 1, 600 V of DC voltage is applied from a DC power source 52 and to the charging sleeve 303 as the second magnetic particle bearing member, 500 V of DC voltage is applied from a DC power source 53. Further, an alternating voltage, which is 1,000 Hz in frequency and 200 V in amplitude, is applied in combination with the DC voltages. Not only does the application of alternating voltage in combination with DC voltage, as in this embodiment, improves the charging process in terms of the potential level to which the photosensitive drum 1 is initially charged, and the level of the nonuniformity in the potential level to which the photosensitive drum 1 becomes charged, but also, it makes the magnetic particle contamination less likely to adversely affect the potential level to which the photosensitive drum 1 becomes charged, and the level of the nonuniformity in the potential level to which the photosensitive drum 1 becomes charged. The amount of the current is measured while the combination of the AC and DC voltages are applied from the current amount measurement DC power sources 63 and 64, and the AC voltage power source 54. Except for the above-described structural arrangement for applying the AC voltage, the structure of the charging apparatus in this embodiment is the same as that in the first embodiment.

Figure 10:
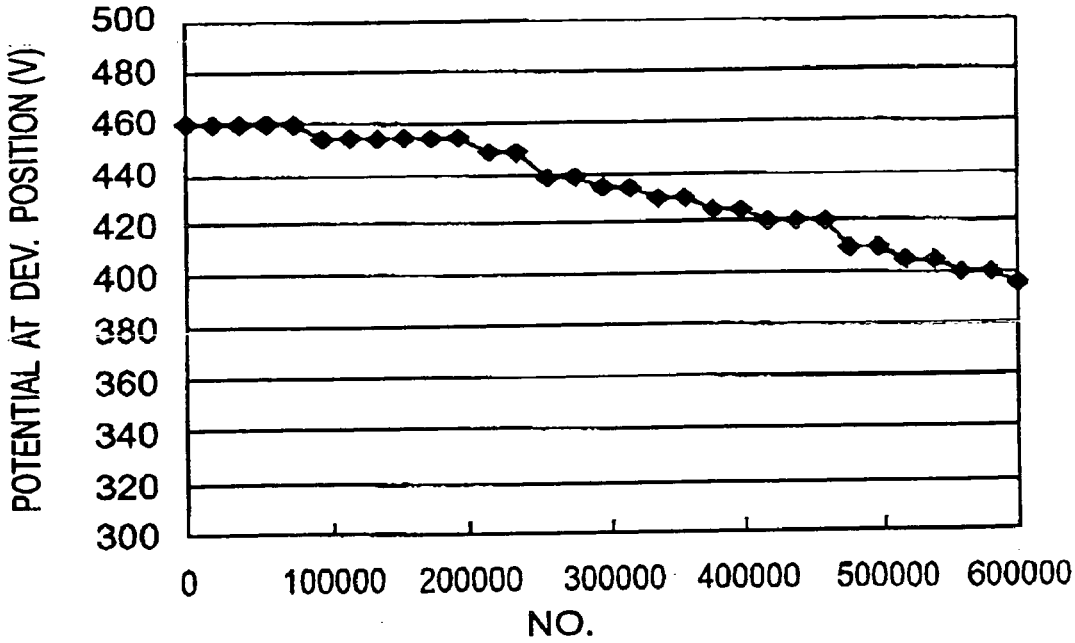
FIG. 10 is a graph showing the changes in the potential level to which the photosensitive drum became charged, which occurred when the magnetic particles were not replaced, in the second embodiment.
Figure 11:
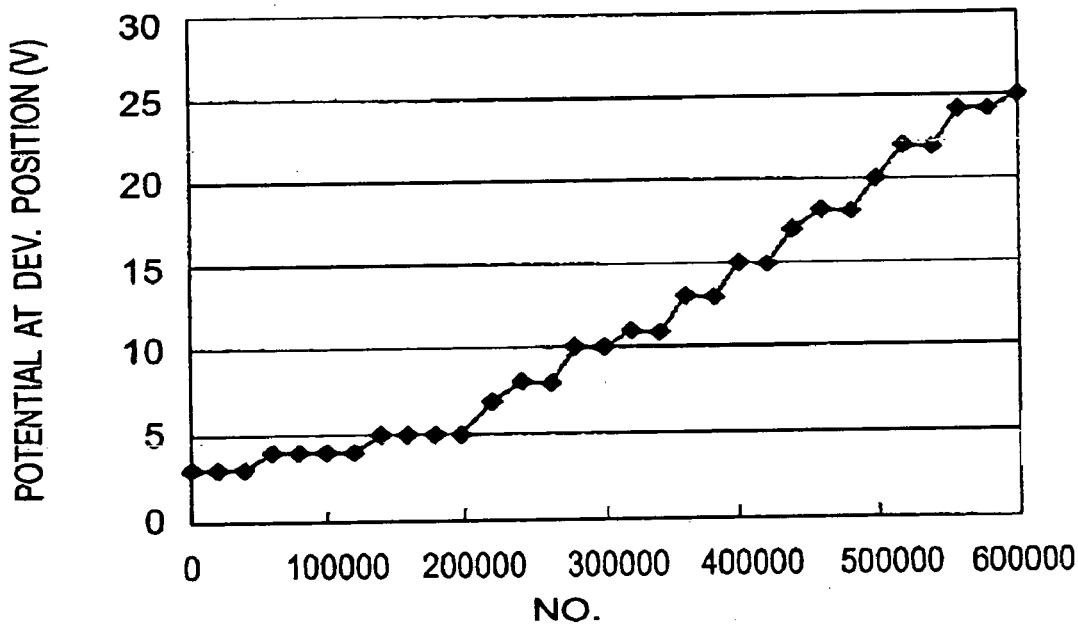
FIG. 11 is a graph showing the changes in the level of the nonuniformity in the potential level to which the photosensitive drum became charged, which occurred when the magnetic particles were not replaced, in the second embodiment.
Figure 12:
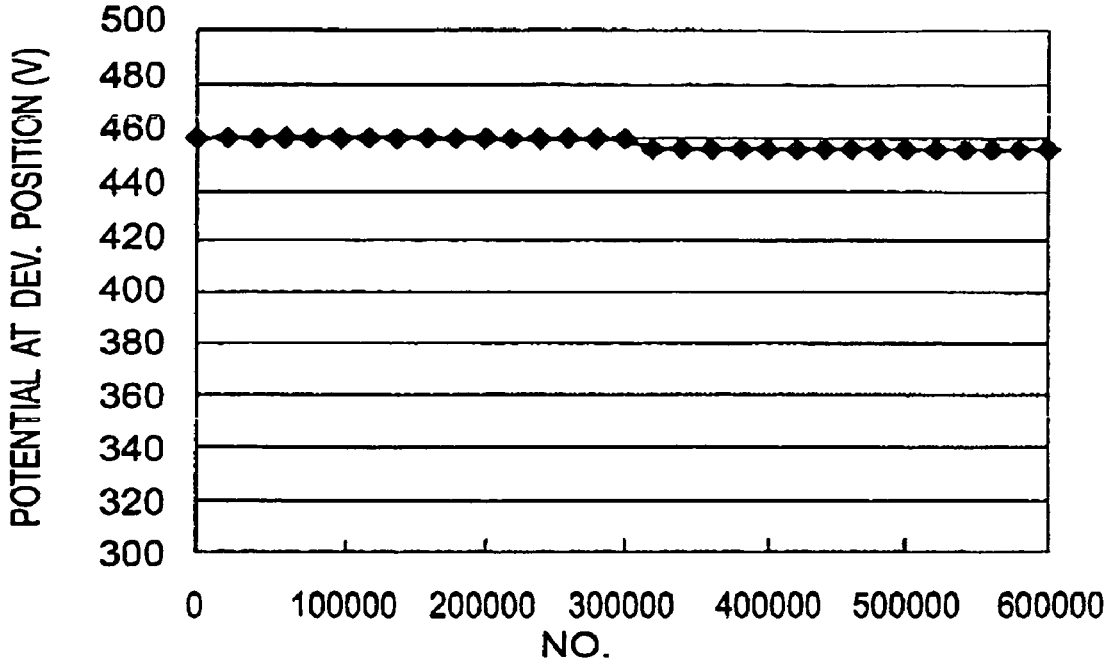
FIG. 12 is a graph showing the changes in the potential level to which the photosensitive drum became charged, which occurred when the magnetic particles were replaced, in the second embodiment.
Figure 13:
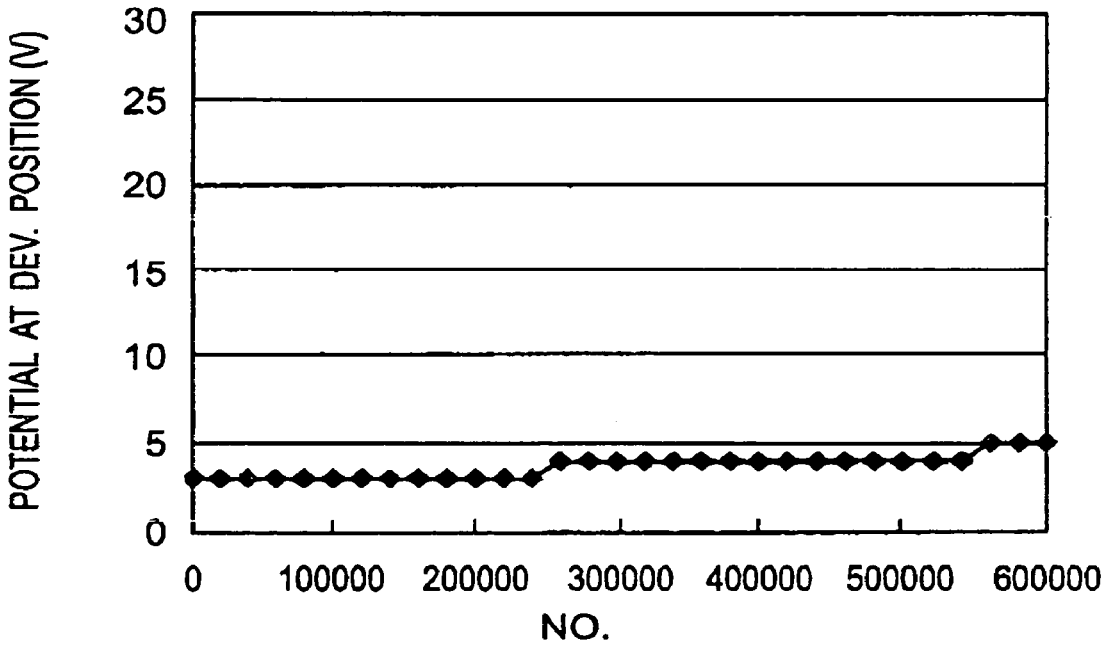
FIG. 13 is a graph showing the changes in the level of the nonuniformity in the potential level to which the photosensitive drum became charged, which occurred when the magnetic particles were replaced, in the second embodiment.
Figure 16:
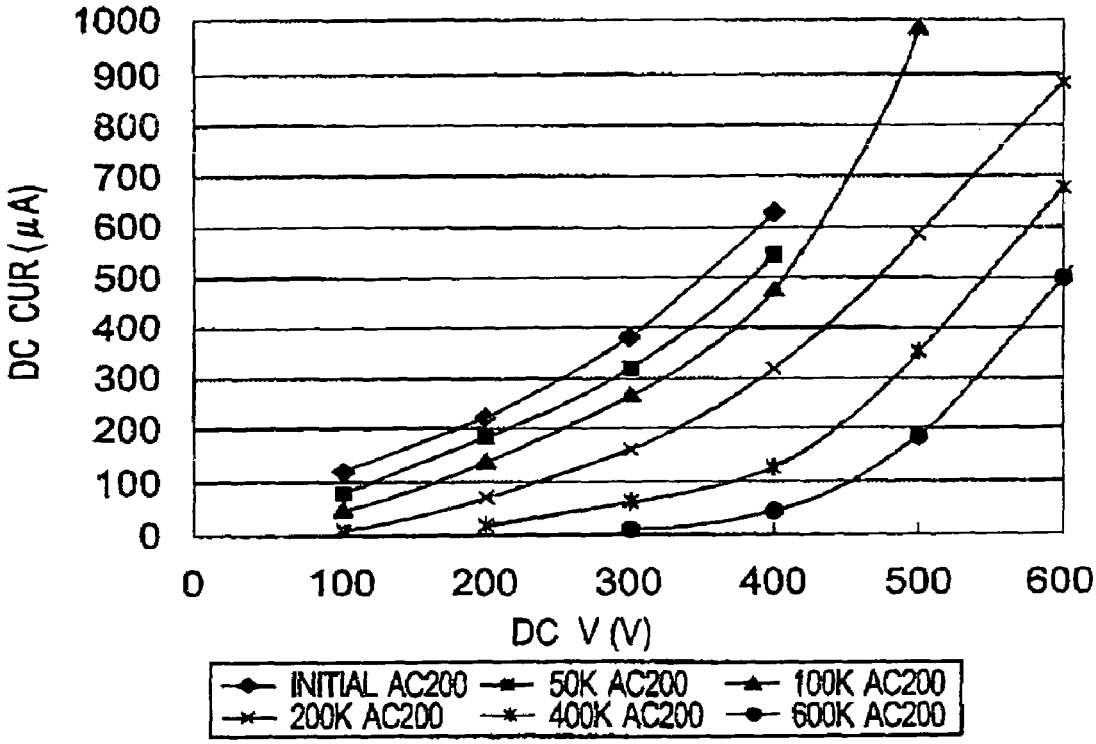
FIG. 16 is a graph showing the changes in the value of the electric current which flowed through the body of magnetic particles, which occurred as the cumulative number of copies made by an image forming apparatus increased, in the second embodiment.

FIG. 10 shows the changes in the potential level at the developing station, which occurred a large number of copies with an image ratio of 7% were continuously printed under the above described charging conditions, without replacing the magnetic particles. FIG. 11 shows the changes in the level of nonuniformity in the potential level to which the photosensitive drum 1 became charged, which occurred under the same conditions as those under which the results shown in FIG. 10 were obtained. Compared to the results shown in FIGS. 6 and 7, the changes in the decrease in the potential level and the changes in the increase in the level of nonuniformity in potential level, which are shown in FIGS. 10 and 11, are more gradual. That is, in terms of the potential level to which the photosensitive drum 1 became charged and the level of nonuniformity in the potential level to which the photosensitive drum 1 became charged, the $50{,}000^{th}$ copy in the first embodiment is equivalent to the $200{,}000^{th}$ copy in this embodiment, and the $400{,}000^{th}$ copy in the fist embodiment is equivalent to the $600{,}000^{th}$ copy in this embodiment. This occurred because not only did the application of alternating voltage in combination with DC voltage improved the charging process in terms of the potential level to which the photosensitive drum 1 was initially charged, and the level of the nonuniformity in the potential level to which the photosensitive drum 1 became charged, but also, it made the magnetic particles contamination less likely to adversely affect the potential level to which the photosensitive drum 1 became charged, and the level of the nonuniformity in the potential level to which the photosensitive drum 1 became charged. FIG. 16 shows the measured amounts of the DC current which flowed when the first charging sleeve 306 was grounded and the combination of DC voltage, and AC voltage which was 1,000 Hz in frequency and 200 V in amplitude, was applied to the second charging sleeve 303 while varying the DC voltage in the range of 6–600 V, with the AC voltage kept constant. As is evident from FIG. 16, in order to keep the charging performance of the charging apparatus in this embodiment at the level corresponding to the $50{,}000^{th}$ copy formed without applying AC voltage as in the first embodiment, the magnetic particles have only to be replaced so that the current amount does not fall below the value corresponding to the $200{,}000^{th}$ copy. In this embodiment, however, in order to keep the charging performance at a higher level, the magnetic particles were replaced so that the current amount did not fall below the value corresponding to the $100{,}000^{th}$ copy. The amount by which the magnetic particles were 10 g, which was the same as that in the first embodiment FIG. 12 shows the changes in the potential level at the developing station, which occurred as a large number of copies with an image ratio of 7% were continuously printed under the above described conditions, and FIG. 13 shows the changes in nonuniformity in the potential level to which the photosensitive drum 1 became charged under the same conditions as those under which the results shown in FIG. 12 were obtained. Compared to the results shown in FIGS. 10 and 11, the improvements similar to those accomplished by the first embodiment are obvious. In other words, this embodiment also made it possible to maintain the potential level to which the photosensitive drum 1 became charged at a value in the preferable range, and also, the level of nonuniformity in the potential level to which the photosensitive drum 1 became charged, at a value in the preferable range, for a long time.

Incidentally, the current amount, based on which the level of the magnetic particle contamination is deduced, may be measured while applying the AC voltage as it is applied during the actual charging of the photosensitive drum 1, as described above, or may be measured while applying only the DC voltage, even though the combination of AC and DC voltages are applied when actually outputting images. When only DC voltage is applied to measure the current amount to deduce the level of magnetic particle contamination, the measurable amount by which the current is reduced by the magnetic particle contamination is greater than when the combination of AC and DC voltages is applied. Therefore, applying only DC voltage when measuring the current amount makes it easier to deduce the level of magnetic particle contamination, making it thereby easier to control the charging process.

(Embodiment 3)

Figure 17:
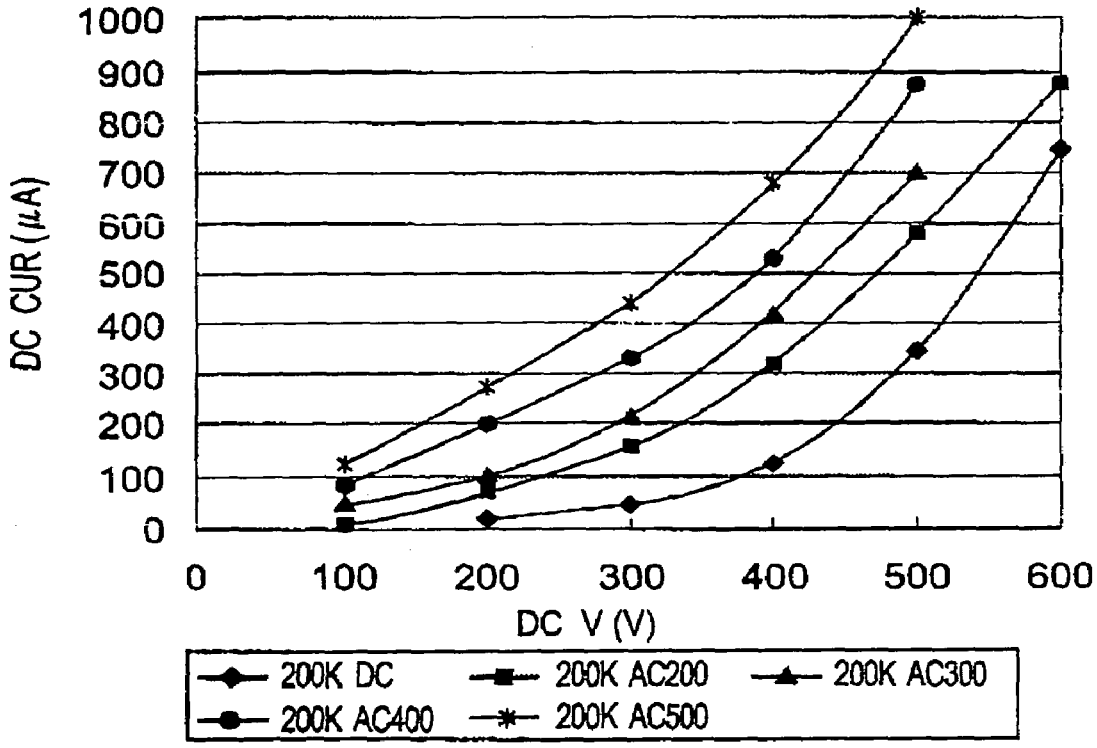
FIG. 17 is a graph showing the relationship between the amount of the electric current which flowed through the body of magnetic particles, and the value of the amplitude (peak-to-peak voltage) of the alternating voltage, measured immediately after $20{,}000^{th}$ copy was outputted, in the third embodiment.

In the first and second embodiment, the magnetic particles 304 were replaced based on the level of the contamination of the magnetic particles 304 deduced by measuring the amount of the current which flowed through the body of the magnetic particles 304 between the first and second magnetic particle bearing members. In this embodiment, however, the magnetic particles 304 are not replaced. Instead, the charging performance of the charging apparatus in this embodiment is maintained by adjusting the amplitude of the AC voltage applied to the charging sleeves, in accordance with the level of the contamination of the magnetic particles 304. As described regarding the second embodiment, the application of AC voltage, in combination with DC voltage, to the charging sleeves during the charging process substantially improves the charging performance of the charging apparatus. FIG. 17 is a graph showing the relationship between the DC voltage applied for measuring the aforementioned current amount, and the amount of the current flowed by the DC voltage, after the formation of 200,000$^{th}$ copy. It is evident from FIG. 17 that the increase in the amplitude of the AC voltage resulted in the increase in the amount of the current which flowed between the two charging sleeves. In other words, it is evident that the increase in the amplitude of the AC voltage greatly contributed to the improvement in the charging performance.

However, increasing the amplitude of the AC voltage does not always positively contribute to the charging performance. For example, when the amplitude is no less than 1,200 V, AC discharge is likely to occur, which often results in the formation of an image which appears smeared. Further, even when the amplitude is no more than 1,200 V, if the amplitude of the AC voltage is greater than necessary, it is difficult for the magnetic particles to move through the charging nip between the photosensitive drum 1 and charging sleeve 303, and the charging nip between the photosensitive drum 1 and charging sleeve 306, stagnating therefore in the adjacencies of the nips. Further, the greater the amplitude of the AC voltage, the more difficult for the foreign substances such as toner particles having mixed into the magnetic brush to be expelled onto the photosensitive drum 1, and therefore, the greater the amount of the toner or the like in the magnetic brush. In this embodiment, therefore, in order to output images while keeping the amplitude of the AC voltage as small as possible within the range in which the charging performance can be maintained, the amplitude of the AC voltage is incrementally increased in accordance with the level of the magnetic particle contamination.

Figure 20:
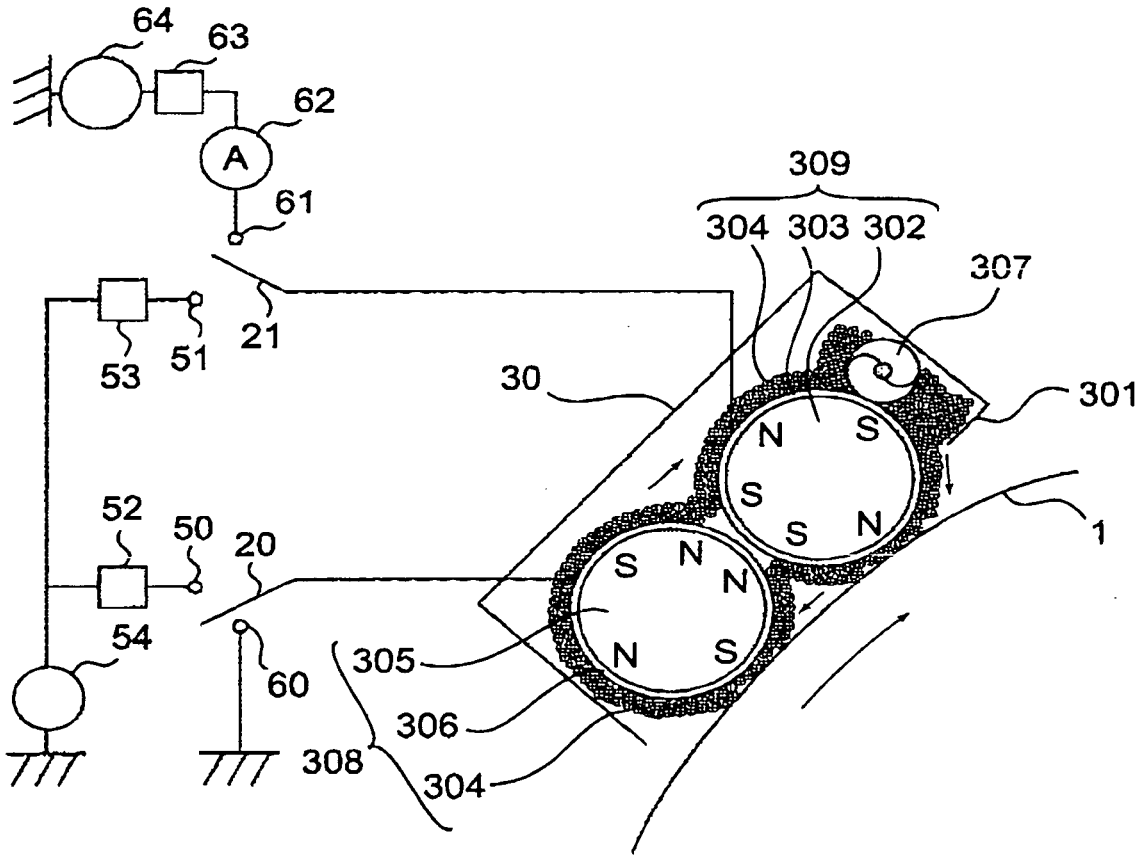
FIG. 20 is a schematic sectional view of the magnetic brush based charging device in the third embodiment of the present invention.

In this embodiment, the afore-mentioned circuits are set up as shown in FIG. 20. When forming images, 600 V of DC voltage is applied to the first charging sleeve 306 from a DC power source 52, and to the second charging sleeve 303, 500 V of DC voltage is applied from a DC power source 53, in order to charge the photosensitive drum 1. Further, during the early stage of the service life of the charging apparatus, AC voltage, which is 1,000 Hz in frequency, is applied to the first and second charging sleeves 306 and 303 from an AC voltage power source 54. Then, as the cumulative number of the outputted copies increases, the amplitude of the AC voltage is gradually increased in accordance with the level of magnetic particle contamination in order to maintain the charging performance. The structural arrangement for switching between the charging circuit and current amount measurement circuit, and the other structural arrangements, are the same as those in the first embodiment.

The above-mentioned control for choosing a proper amplitude for the AC voltage in accordance with the cumulative number of the outputted copies is carried out in the following manner: First, when the charging apparatus is in the early stage of its usage, the amount of the current which flows through the body of magnetic particles between the first and second charging sleeves is measure, while varying, in the range of 0–600 V, the potential level of the DC voltage applied to the second charging sleeve, with the first charging sleeve grounded. Then, as the cumulative number of the outputted copes reaches a predetermined value, the amount of the current which flows through the body of magnetic particles between the two charging sleeves is measured. During this measurement, the first charging sleeve is kept grounded, and DC voltages, the potential levels of which are in the range of 6–600 V, are applied to the second charging sleeve. Also during this measurement, an AC voltage is applied to the second charging sleeve from a current amount measurement AC voltage source 64. The AC voltage applied in combination with the DC voltage is incrementally increased from 0 V, with its frequency kept at 1,000 Hz, while measuring the amount of the current which flows the body of magnetic particles between the two charging sleeves, with the use of a current meter 62, in order to find the amplitude at which the current amount becomes close to the current amount in the early stage of the charging apparatus usage. Then, this value of the amplitude is used as the value for the amplitude of the AC voltage to be applied for outputting images. In other words, the value for the amplitude for the AC voltage to be applied during the charging of the photosensitive drum is determined by measuring the amount of the current which flows through the body of magnetic particles between the two magnetic particles bearing members.

Figure 18:
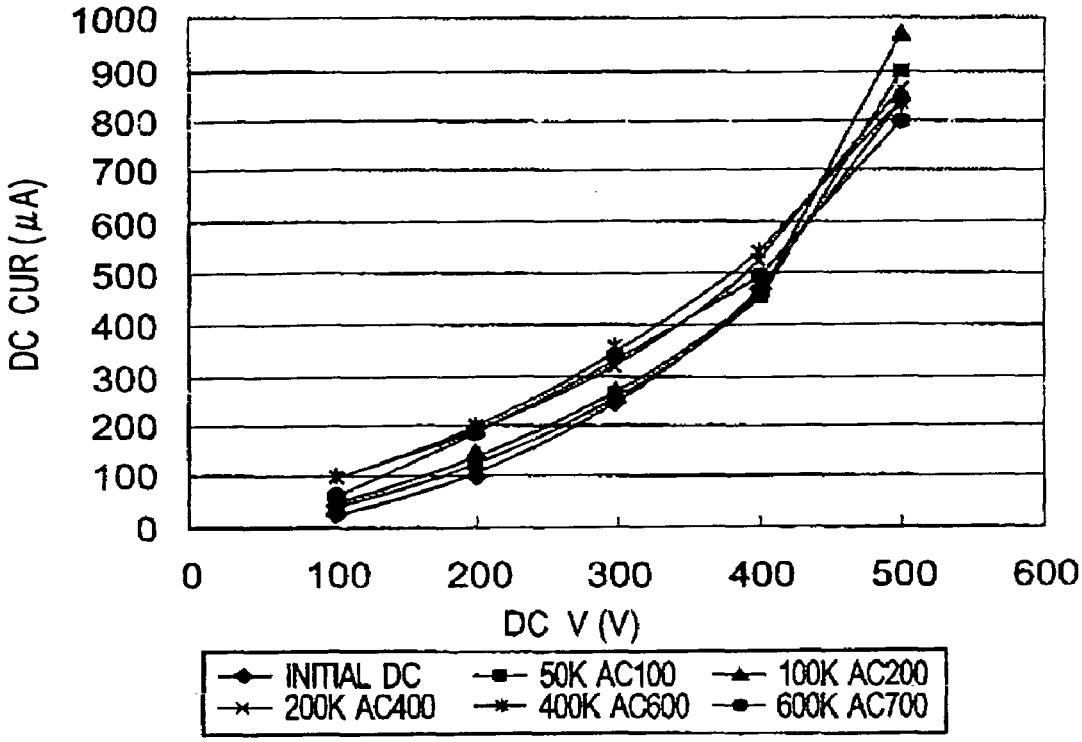
FIG. 18 is a graph showing the changes in the amount of the electric current which flowed through the body of magnetic particles, which occurred as the amplitude of the alternating voltage was changed in response to the cumulative number of copies made by the image forming apparatus, in the third embodiment.

FIG. 18 is a graph showing the changes in the relationship between the potential level of the DC voltage applied to the second charging sleeve and the amount of the current which flowed through the body of magnetic particles between the two charging sleeves, which occurred as the amplitude of the AC voltage applied to enhance the charging performance was varied, and also, as the cumulative number of outputted copies increased. As will be evident from FIG. 18, in the early stage of the charging apparatus usage, only the DC voltage was applied, whereas as the cumulative number of the outputted copies increased, the AC voltage was increased in amplitude: to 100 V at 50,000$^{th}$ copy; to 200 V at is 100,000$^{th}$ copy; to 400 V at 200,000$^{th}$ copy; to 600 V at 400,000$^{th}$ copy; and to 700 V at 600,000$^{th}$ copy. As a result, the measured amount of the current remained roughly the same in spite of the increase in the cumulative number of outputted copies.

In this embodiment, when outputting images, the amplitude of the AC voltage to be applied, in combination with the DC voltage, to the first and second charging sleeves 306 and 303 was determined in accordance with the amount of the current which flowed through the body of magnetic particles between the two charging sleeves, and which was measured while adjusting the AC voltage to be applied to the first and second charging sleeves 306 and 303. In other words the amplitude of the AC voltage was incrementally increased in accordance with the increase in the magnetic particle contamination resulting from the increases in the cumulative number of the outputted copies, by deducing the level of the magnetic particle contamination from the measured amount of the current which flowed through the body of magnetic particles between the two magnetic particle bearing members. As a result, the charging performance could be kept at a level roughly the same as the charging performance level in the early stage of the charging apparatus usage, that is, the level at which images of good quality could be formed, without replacing the magnetic particles.

Figure 14:
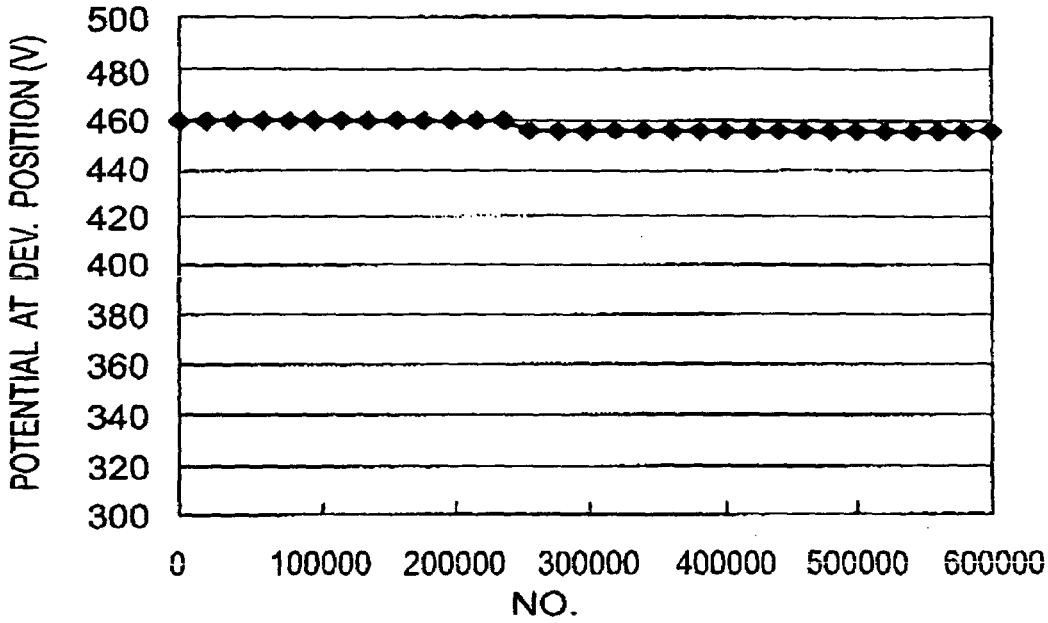
FIG. 14 is a graph showing the changes in the potential level to which the photosensitive drum became charged when the alternating voltage was varied in response to the current value, in the third embodiment.
Figure 15:
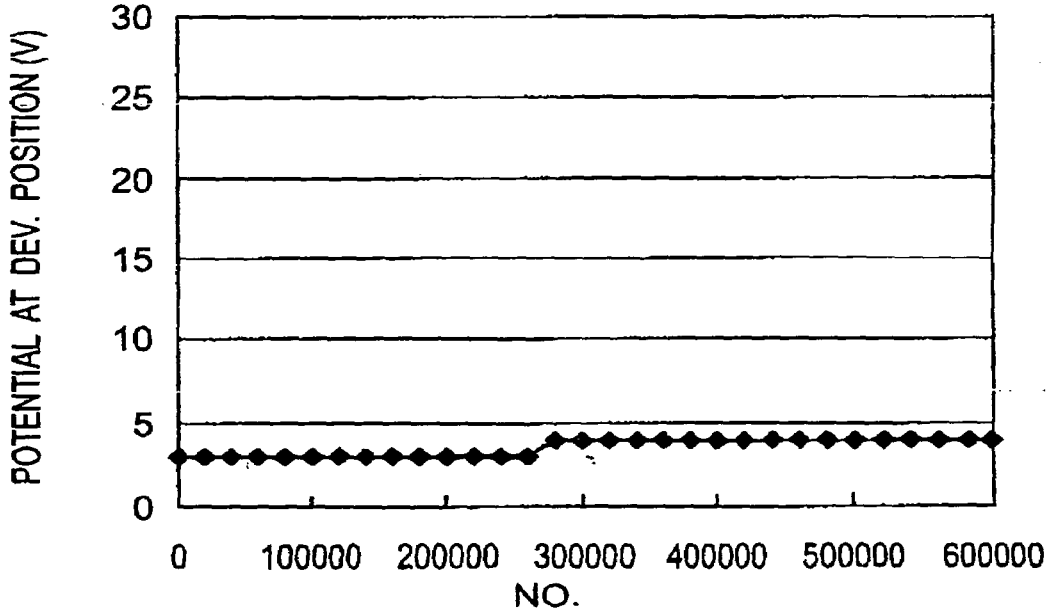
FIG. 15 is a graph showing the changes in the level of nonuniformity in the potential level to which the photosensitive drum became charged, when the alternating voltage was varied in response to the current value, in the third embodiment.

FIG. 14 shows the changes in the potential level at the developing station, which occurred when a large number of copies with an image ratio of 7% were continuously printed under the above described conditions in this embodiment, and FIG. 15 shows the changes in the level of nonuniformity in the potential level to which the photosensitive drum 1 became charged, which occurred under the same conditions as those under which the results shown in FIG. 14 were obtained. It is evident from FIGS. 14 and 15 that by preventing the charging performance from falling due to the magnetic particle contamination, by incrementally increasing the amplitude of the AC voltage applied, in addition to the DC voltage, to the charging sleeves, in accordance with the level of the magnetic particle contamination deduced by measuring the amount of the current which flowed through the body of magnetic particles between the two magnetic particle bearing members, at a predetermined interval in terms of the cumulative number of the outputted copies, the potential level to which the photosensitive drum 1 became charged, and the level of nonuniformity in the potential level to which the photosensitive drum 1 became charged, were maintained in the satisfactory ranges, respectively, for a long time.

Although in this embodiment, the value for the amplitude of the AC voltage to be applied for image formation, which was determined by deducing the level of magnetic particle contamination, was used as the value for the amplitude of the AC voltage to be applied, in combination with the DC voltage, to the first charging sleeve as well as the value for the amplitude of the AC voltage to be applied, in combination with the DC voltage, to the second charging sleeve, the two charging sleeves do not need to be the same in the amplitude of the AC voltage applied thereto. Further, it may be only one of the first and second charging sleeves 306 and 303 that is changed in the amplitude of the AC voltage applied thereto. The first charging sleeve 306 is greater in the amount of the current which flows during the charging of the photosensitive drum 1, being therefore greater in the amount of influence upon the charging process. Thus, it is desired that the above-mentioned value obtained for the amplitude of the AC voltage to be applied for charging the photosensitive drum 1 is used as the value for the AC voltage applied to the first charging sleeve 306. This, however, is not mandatory.

As described above, in this embodiment, one or both of the AC voltages applied, in combination with the DC voltage, to the first and second charging sleeves are incrementally increased in amplitude, in accordance with the level of the magnetic particle contamination. Therefore, the charging performance can be maintained without replacing the magnetic particles, despite the magnetic particle contamination.

Incidentally, in the first and second embodiments, a screw is employed as the means for replacing the magnetic particles. However, they are not intended to limit the scope of the present invention. For example, the magnetic particle may be simply supplied from a magnetic particle supply container. Further, the magnetic particles may be replaced even when the amplitude of the AC voltage is changed as it is in the third embodiment.

Further, the first to third embodiments may be combined with a method for displaying on an unshown control panel or the like, the arrival of the time for simply supplying the charging apparatus with magnetic particles, or replacing the magnetic particles. In this case, magnetic particles may be manually supplied, or a magnetic particle supply cartridge may be manually replaced.

Further, in the first to third embodiments, the circuits for measuring the current amount was designed as shown in FIGS. 2, 19, and 20, respectively. However, these circuit designs are not intended to limited the scope of the present invention. For example, the circuits may be designed so that a single power source can be shared by the charging circuit and current amount measurement circuit. Further, the current amount measuring means may be placed between the current amount measurement circuit 60 and ground. What is important here is that the current amount measurement circuit is designed and positioned so that the amount of the current which flows through the body of magnetic particles between the first and second magnetic particle bearing members can be measured by the measurement circuit, regardless of the positioning of the power sources and current amount measuring apparatus.

It does not matter whether or not a DC voltage power source is used as the power source, and also, it does not manner whether or not AC voltage is applied in combination with DC voltage.

Although in the preceding embodiments, the rotation of the photosensitive drum 1 is stopped to measure the amount of the current which flows through the body of magnetic particles between the charging sleeves. However, all that is necessary is that the charging apparatuses structured so that when measuring the amount of the above-mentioned current, current can be prevented from flowing between the magnetic brush and the object to be charged. For example, the magnetic brush based charging apparatus may be structured so that when measuring the amount of the above-mentioned current, it can be separated from the photosensitive drum, or a piece of insulating plate can be inserted into the charging nips while allowing the photosensitive drum to keep on rotating.

Also in the first to third embodiments, in order to measure the amount of the current to detect the level of magnetic particle contamination, DC voltage is applied to the second charging sleeve 303 while varying the potential level thereof in the range of 0–600 V, and AC voltage is not applied, or applied, in combination with the DC voltage, while not varying, or varying, it in amplitude However, they are not intended to limit the scope of the present invention. For example, voltage may be applied to the first charging sleeve 306 with the second charging sleeve 303 grounded, or two different DC voltages may be applied to the first and second charging sleeves, one for one, with both the first and second charging sleeves grounded. Further, instead of varying, in potential level, the DC voltage applied to the second charging sleeve 303 as it is in the second embodiment, the level of the magnetic particle contamination may be detected by measuring the amount of the above-mentioned current while keeping the potential level of the DC voltage fixed, for example, to 300 V.

The gist of the present invention is to precisely detect the level of the magnetic particle contamination by measuring the amount of the current which flows through the body of magnetic particles between the two charging sleeves, and to maintain the charging performance of a magnetic brush based charging apparatus at a predetermined level in accordance with the level of magnetic particle contamination deduced from the measured amount of the current. In other words, the present invention is not intended to limit the method for applying voltage, means for maintaining the level of charging performance in accordance with the results of detection, etc.

While the invention has been described with reference to the structures disclosed herein, it is not confined to the details set forth, and this application is intended to cover such modifications or changes as may come within the purposes of the improvements or the scope of the following claims.

What is claimed is:

1. A charging apparatus comprising:

a first magnetic particle carrying member for carrying magnetic particles;

a second magnetic particle carrying member for carrying the magnetic particles, said second magnetic particle carrying member being disposed downstream of said first magnetic particle carrying member with respect to a moving direction of a member to be charged, wherein the magnetic particles are commonly used by said first magnetic particle carrying member and said second magnetic particle carrying member, and the member to be charged is electrically charged by contacting the magnetic particles carried on said first magnetic particle carrying member and said second magnetic particle carrying member to said member to be charged; and current measuring means for measuring a current flowing between said first and second magnetic particle carrying members through the magnetic particles which are commonly used by said first and second magnetic particle carrying members.

2. An apparatus according to claim 1, wherein the current is measured with a potential difference provided between said first magnetic particle carrying member and said second magnetic particle carrying member.

3. An apparatus according to claim 2, wherein the current is measured a plurality of times with different potential differences provided between said first magnetic particle carrying member and said second magnetic particle carrying member.

4. An apparatus according to claim 1, wherein said current measuring means measures the current when the member to be charged is not driven.

5. An apparatus according to claim 1, further comprising supplying/exchanging means for supplying or exchanging said magnetic particles on the basis of the current.

6. An apparatus according to claim 1, wherein supplying or exchanging of the magnetic particles is prompted on the basis of the current.

7. An apparatus according to claim 1, wherein amplitudes of AC voltages applied to said first magnetic particle carrying member and to said second magnetic particle carrying member are controlled on the basis of the current during image forming operation.

8. An apparatus according to claim 1, wherein the current is measured when a non-image formation region is at a charging position.

9. An apparatus according to claim 1, wherein the member to be charged is a photosensitive member comprising amorphous silicon layer.

10. An apparatus according to claim 1, further comprising magnetic field generating means which is disposed inside said first magnetic particle carrying member and said second magnetic particle carrying member and which includes a plurality of magnetic poles for magnetically confining the magnetic particles, wherein said magnetic poles are such that magnetic poles of the same polarity are disposed adjacent to each other.

11. An apparatus according to claim 1, wherein a region where the magnetic poles of the same polarity is disposed at a position where said first magnetic particle carrying member and said second magnetic particle carrying member are opposed to each other, and opposing ones of said magnetic poles disposed in said first magnetic particle carrying member and said second magnetic particle carrying member, respectively, have different magnetic polarities.

12. An apparatus according to claim 1, wherein the magnetic particles carried on said first magnetic particle carrying member and said second magnetic particle carrying member are contacted to the member to be charged, and electrical charging is effected by direct injection of electric charge.

13. An apparatus according to claim 1, wherein the member to be charged is an image bearing member, and the image bearing member, said first and second magnetic particle carrying member are provided in a process cartridge detachably mountable to a main assembly of an image forming apparatus.

14. An image forming apparatus comprising:

a photosensitive member;

a charging device;

said charging device including, a first magnetic particle carrying member for carrying magnetic particles;

a second magnetic particle carrying member for carrying the magnetic particles, said second magnetic particle carrying member being disposed downstream of said first magnetic particle carrying member with respect to a moving direction of a member to be charged, wherein the magnetic particle are commonly used by said first magnetic particle carrying member and said second magnetic particle carrying member, and said photosensitive member is electrically charged by contacting the magnetic particles carried on said first magnetic particle carrying member and said second magnetic particle carrying member to said photosensitive member;

current measuring means for measuring a current flowing between said first and second magnetic particle carrying members through the magnetic particles which are commonly used by said first and second magnetic particle carrying member; and image exposure means for forming an electrostatic latent image by exposing said photosensitive member to light;

developing means for forming a toner image by developing the electrostatic latent image; and transferring means for transferring the toner image onto a transfer material.

* * * * *

UNITED STATES PATENT AND TRADEMARK OFFICE

CERTIFICATE OF CORRECTION

PATENT NO. : 7,103,303 B2
APPLICATION NO. : 10/849157
DATED : September 5, 2006
INVENTOR(S) : Hiroyuki Suzuki et al.

It is certified that error appears in the above-identified patent and that said Letters Patent is hereby corrected as shown below:

ON THE TITLE PAGE AT ITEM (57), Abstract:
Line 7, “particle” should read --particles--.

COLUMN 3:
Line 47, “photonlic” should read --photonic--.
Line 61, “siubstantially” should read --substantially--.

COLUMN 8:
Line 45, “nonuniformly” should read --nonuniformity--.
Line 60, “photonic are” should read --photonic carriers are--.

COLUMN 9:
Line 10, “an” should read --a--.

COLUMN 10:
Line 35, “utilizes” should read --utilize--.

COLUMN 11:
Line 21, “ether,” should read --other,--.

COLUMN 13:
Line 54, “in” should be deleted.

COLUMN 14:
Line 36, “mount” should read --amount--.

COLUMN 15:
Line 30, “reduce” should read --to reduce--.

COLUMN 16:
Line 18, “fist” should read --first--.
Line 22, “improved” should read --improve--.

COLUMN 18:
Line 19, “measure,” should read --measured,--.
Line 23, “copes” should read --copies--.

UNITED STATES PATENT AND TRADEMARK OFFICE

CERTIFICATE OF CORRECTION

PATENT NO. : 7,103,303 B2
APPLICATION NO. : 10/849157
DATED : September 5, 2006
INVENTOR(S) : Hiroyuki Suzuki et al.

It is certified that error appears in the above-identified patent and that said Letters Patent is hereby corrected as shown below:

COLUMN 20:
Line 7, “particle” should read --particles--.
Line 22, “limited” should read --limit--.
Line 37, “manner” should read --matter--.
Line 39, “Although in” should read --In--.

COLUMN 22:
Line 30, “and the” should read --and in the--.
Line 32, “member” should read --members--.
Line 46, “particle” should read --particles--.
Line 58, “member; and” should read --members;--.

Signed and Sealed this

Twenty-sixth Day of June, 2007

JON W. DUDAS
*Director of the United States Patent and Trademark Office*